US010984734B2

(12) United States Patent
Ueno

(10) Patent No.: US 10,984,734 B2
(45) Date of Patent: Apr. 20, 2021

(54) BACKLIGHT DRIVING DEVICE

(71) Applicant: SHARP KABUSHIKI KAISHA, Sakai (JP)

(72) Inventor: Kohji Ueno, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

(21) Appl. No.: 16/928,987

(22) Filed: Jul. 14, 2020

(65) Prior Publication Data

US 2021/0020117 A1 Jan. 21, 2021

Related U.S. Application Data

(60) Provisional application No. 62/876,476, filed on Jul. 19, 2019.

(51) Int. Cl.
*G09G 3/34* (2006.01)

(52) U.S. Cl.
CPC ... *G09G 3/3406* (2013.01); *G09G 2320/0233* (2013.01); *G09G 2320/0693* (2013.01)

(58) Field of Classification Search
CPC ..... G09G 2330/012; G09G 2330/021; G09G 2320/0626; G09G 2320/043; G09G 2320/0233; G09G 3/3233; G09G 3/006; G09G 3/2014; G09G 3/2011; G09G 3/3283; G09G 3/3406; G09G 3/0413; G09G 3/342; G09G 3/3426; G09G 2310/02
See application file for complete search history.

(56) References Cited

U.S. PATENT DOCUMENTS

2010/0177127 A1* 7/2010 Akiyama ..... G09G 3/36 345/690
2011/0007104 A1* 1/2011 Nakazawa ..... G09G 3/3413 345/690
2012/0056561 A1* 3/2012 Adachi ..... G09G 3/00 315/297
2013/0099681 A1* 4/2013 Williams ..... H05B 45/347 315/185 R
2020/0410916 A1* 12/2020 Ouyang ..... G11C 19/28

FOREIGN PATENT DOCUMENTS

JP 2013-222515 A 10/2013

* cited by examiner

*Primary Examiner* — Dong Hui Liang
(74) *Attorney, Agent, or Firm* — ScienBiziP, P.C.

(57) ABSTRACT

A backlight driving device includes a plurality of drivers configured to drive a plurality of light-emitting elements arranged in a planar shape in a predetermined drive unit, and a control unit configured to output drive data directed to each of the plurality of drivers. The plurality of drivers are cascaded, each of the plurality of drivers bi-directionally performs an operation of, in a case of receiving the drive data directed to another driver input from a previous stage, outputting the drive data to a subsequent stage in a row of the plurality of drivers cascaded. In a case that at least one of the plurality of drivers has an abnormality, the control unit outputs the drive data to the driver located at one end of the plurality of drivers, and then outputs the drive data to the driver located at the other end of the plurality of drivers.

7 Claims, 21 Drawing Sheets

| | ACK SIGNAL | | | | | | DETERMINATION RESULT |
|---|---|---|---|---|---|---|---|
| | T1 | | | T2 | | | |
| | 211A | 212A | 213A | 211A | 212A | 213A | |
| E1 | ✓ | ✓ | ✓ | — | — | — | ABNORMALITY IN NONE OF DRIVERS 211A TO 213A |
| E2 | × | × | × | × | × | × | ABNORMALITY IN MAIN WIRING FOR COMMON SIGNAL |
| E3 | × | × | × | × | ✓ | ✓ | ABNORMALITY IN BRANCH LINE OF COMMON SIGNAL CONNECTED TO DRIVER 211A OR IN DRIVER 211A |
| E4 | ✓ | × | × | × | × | ✓ | ABNORMALITY IN BRANCH LINE OF COMMON SIGNAL CONNECTED TO DRIVER 212A OR IN DRIVER 212A |
| E5 | ✓ | ✓ | × | × | × | × | ABNORMALITY IN BRANCH LINE OF COMMON SIGNAL CONNECTED TO DRIVER 213A OR IN DRIVER 213A |
| E6 | × | × | × | ✓ | ✓ | ✓ | ABNORMALITY BETWEEN SPIO TERMINAL OF CONTROL UNIT AND SPIO TERMINAL OF DRIVER 211A |
| E7 | ✓ | × | × | × | ✓ | ✓ | ABNORMALITY BETWEEN SPOI TERMINAL OF DRIVER 211A AND SPIO TERMINAL OF DRIVER 212A |
| E8 | ✓ | ✓ | × | × | × | ✓ | ABNORMALITY BETWEEN SPOI TERMINAL OF DRIVER 212A AND SPIO TERMINAL OF DRIVER 213A |

Fig.8

| | CASE 1 | CASE 2 | CASE 3 | CASE 4 | CASE 5 | CASE 6 |
|---|---|---|---|---|---|---|
| DRIVER 211A | × | 1.5 | 1 | 1 | 1 | 1.5 |
| DRIVER 212A | 1.5 | × | 1.5 | 1 | 1 | 1 |
| DRIVER 213A | 1 | 1.5 | × | 1.5 | 1 | 1 |
| DRIVER 214A | 1 | 1 | 1.5 | × | 1.5 | 1 |
| DRIVER 215A | 1 | 1 | 1 | 1.5 | × | 1.5 |
| DRIVER 216A | 1.5 | 1 | 1 | 1 | 1.5 | × |

Fig.15

| | | | | | | | | |
|---|---|---|---|---|---|---|---|---|
| 1 | 1 | 1 | 1 | 1 | 1 | 1 | 1 | 1 |
| 1 | 1 | 1 | 1 | 1 | 1 | 1 | 1 | 1 |
| 1 | 1.25 | 1 | 1 | 1 | 1 | 1 | 1 | 1 |
| 1.25 | 0 | 1.25 | 1 | 1 | 1 | 1 | 1 | 1 |
| 1 | 1.25 | 1 | 1 | 1 | 1 | 1 | 1 | 1 |

Fig.19

| | | | | | | | | |
|---|---|---|---|---|---|---|---|---|
| 0 | 1.5 | 1 | 1 | 1 | 1 | 1 | 1 | 1 |
| 1.5 | 1 | 1 | 1 | 1 | 1 | 1 | 1 | 1 |
| 1 | 1 | 1 | 1 | 1 | 1 | 1 | 1 | 1 |
| 1 | 1 | 1 | 1 | 1 | 1 | 1 | 1 | 1 |
| 1 | 1 | 1 | 1 | 1 | 1 | 1 | 1 | 1 |

Fig.20

| | | | | | | | | |
|---|---|---|---|---|---|---|---|---|
| 1 | 1 | 1 | 1 | 1 | 1 | 1 | 1 | 1 |
| 1.375 | 1 | 1 | 1 | 1 | 1 | 1 | 1 | 1 |
| 0 | 1.375 | 1 | 1 | 1 | 1 | 1 | 1 | 1 |
| 1.375 | 1 | 1 | 1 | 1 | 1 | 1 | 1 | 1 |
| 1 | 1 | 1 | 1 | 1 | 1 | 1 | 1 | 1 |

Fig.21

BACKLIGHT DRIVING DEVICE

CROSS-REFERENCE TO RELATED APPLICATION

The present application claims priority Provisional Application No. 62/876,476, the content to which is hereby incorporated by reference into this application.

BACKGROUND OF THE INVENTION

1. Field of the Invention

A disclosure described below relates to a backlight driving device for driving a light-emitting element of a backlight.

2. Description of the Related Art

A display device includes a backlight illuminating light, and a display panel controlling a transmission amount of light emitted by the backlight to display an image. Examples of the backlight include those having a plurality of light emitting diodes (LEDs) arranged in a planar shape as a light source. Some backlights having LEDs perform local dimming in which the LEDs are driven for each predetermined area to enhance a contrast of an image.

The display device provided with the backlight having LEDs is used for tablet terminals, automobile meter panels, and the like as well as televisions, personal computer monitors, and the like. In such a display device, abnormalities may occur, for example, some of the LEDs of the backlight are not able to light up, and in such a display device, a countermeasure for that case is an issue. For example, JP 2013-222515 A describes a display device for giving notice of an LED having an abnormality, by causing a light emission intensity of LEDs disposed around the LED having an abnormality to be different from other LEDs.

In such a display device described above, even if an abnormality occurs in the backlight, it may be necessary to continue display while suppressing deterioration of display quality as much as possible. For example, in a meter panel of an automobile or the like, even if abnormalities occur in the backlight, there is a strong need to continue to display to an extent visible. However, the display device described in JP 2013-222515 A only gives notice of an abnormal LED, and cannot suppress degradation of display quality.

In particular, in the backlights that drive LEDs for each predetermined area, a plurality of drivers driving the LEDs are often cascaded (daisy chain connected). In such a backlight, in a case where some of the drivers have abnormalities, all of the drivers after the drivers having the abnormalities cannot drive the LEDs, so the display quality of the display device deteriorates greatly.

SUMMARY OF THE INVENTION

In order to solve the above problem, a backlight driving device according to an embodiment of the present disclosure is includes: a plurality of drivers configured to drive a plurality of light-emitting elements arranged in a planar shape in a predetermined drive unit; and a control unit configured to output drive data directed to each of the plurality of drivers, wherein the plurality of drivers are cascaded, each of the plurality of drivers bi-directionally performs an operation of, in a case of receiving the drive data directed to another driver input from a previous stage, outputting the drive data to a subsequent stage in a row of the plurality of drivers cascaded, and in a case that at least one of the plurality of drivers has an abnormality, the control unit outputs the drive data directed to each of the plurality of drivers to a driver located at one end of the plurality of drivers, and then outputs the drive data to a driver located at the other end of the plurality of drivers.

In the backlight driving device having the configuration described above, even in a case that some of the plurality of cascaded drivers cannot transfer the drive data, the drive data is provided to as many drivers as possible. Accordingly, as many light-emitting elements as possible can be driven to suppress degradation of display quality in the display device.

BRIEF DESCRIPTION OF DRAWINGS

FIG. 8 is a table illustrating a method for identifying a faulty portion, based on error data.

FIG. 15 is a table illustrating a driving method of a drive unit by a driver having no abnormality in a case that each of the drivers 211A to 216A has an abnormality.

FIG. 19 is a table illustrating a driving method in a case that some drive units are incapable of being driven, the driving method being for other drive units.

FIG. 20 is a table illustrating a driving method in a case that some drive units are incapable of being driven, the driving method being for other drive units.

FIG. 21 is a table illustrating a driving method in a case that some drive units are incapable of being driven, the driving method being for other drive units.

DETAILED DESCRIPTION OF THE INVENTION

Figure 1:
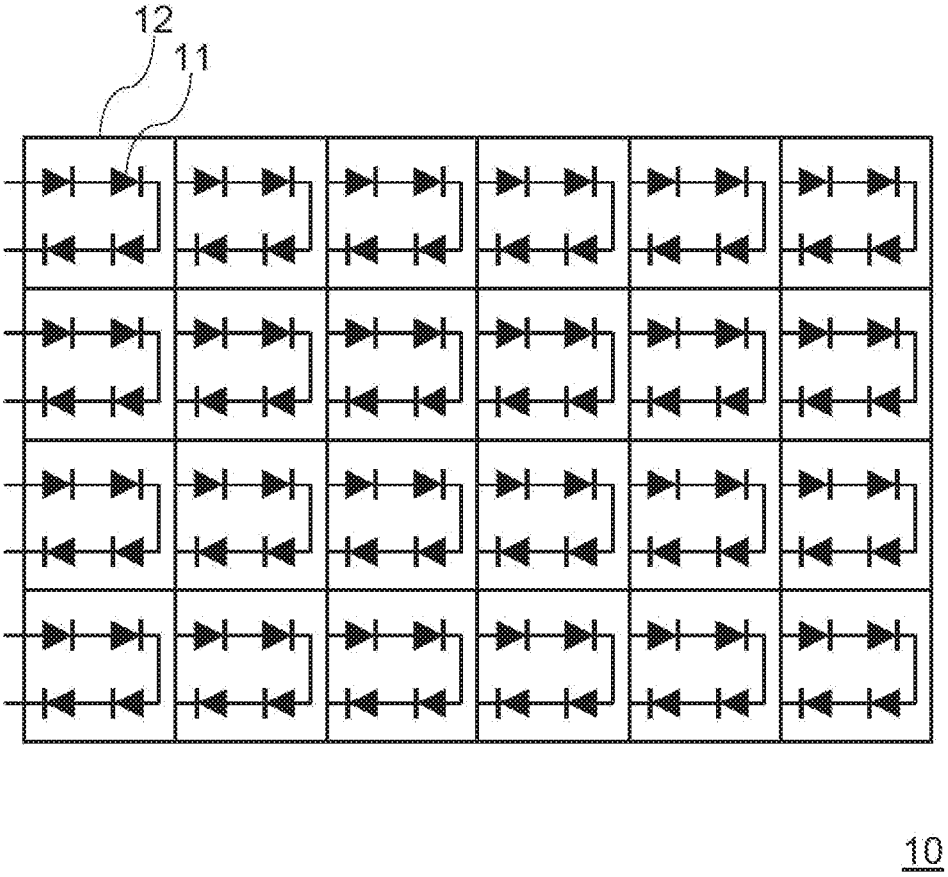
FIG. 1 is a circuit diagram illustrating an arrangement example of LEDs 11 included in a backlight 10.

Hereinafter, embodiments of the present disclosure will be described in detail with reference to the drawings. In the drawings, identical or corresponding parts are denoted by the same reference signs, and the description thereof will not be repeated. Note that, for ease of explanation, in the drawings referred to below, the configuration is simplified or schematically illustrated, or some of the components are omitted. Also, the dimensional ratios between the components illustrated in the figures are not necessarily indicative of actual dimensional ratios.

First Embodiment

Firstly, a configuration of a backlight will be described. FIG. 1 is a circuit diagram illustrating an arrangement example of LEDs 11 (light-emitting element) included in a backlight 10. As illustrated in FIG. 1, the backlight 10 includes the LEDs 11 arranged in a planar shape. For example, the backlight 10 includes a total of 96 LEDs 11, horizontal 12×vertical 8, arranged in a matrix. In the backlight 10, the LEDs 11 are driven for each drive unit 12 in which a total of 4 LEDs 11, horizontal 2×vertical 2, are connected in series. The drive units 12 the number of which is 24 in total, horizontal 6×vertical 4, are arranged in a matrix.

Figure 2:
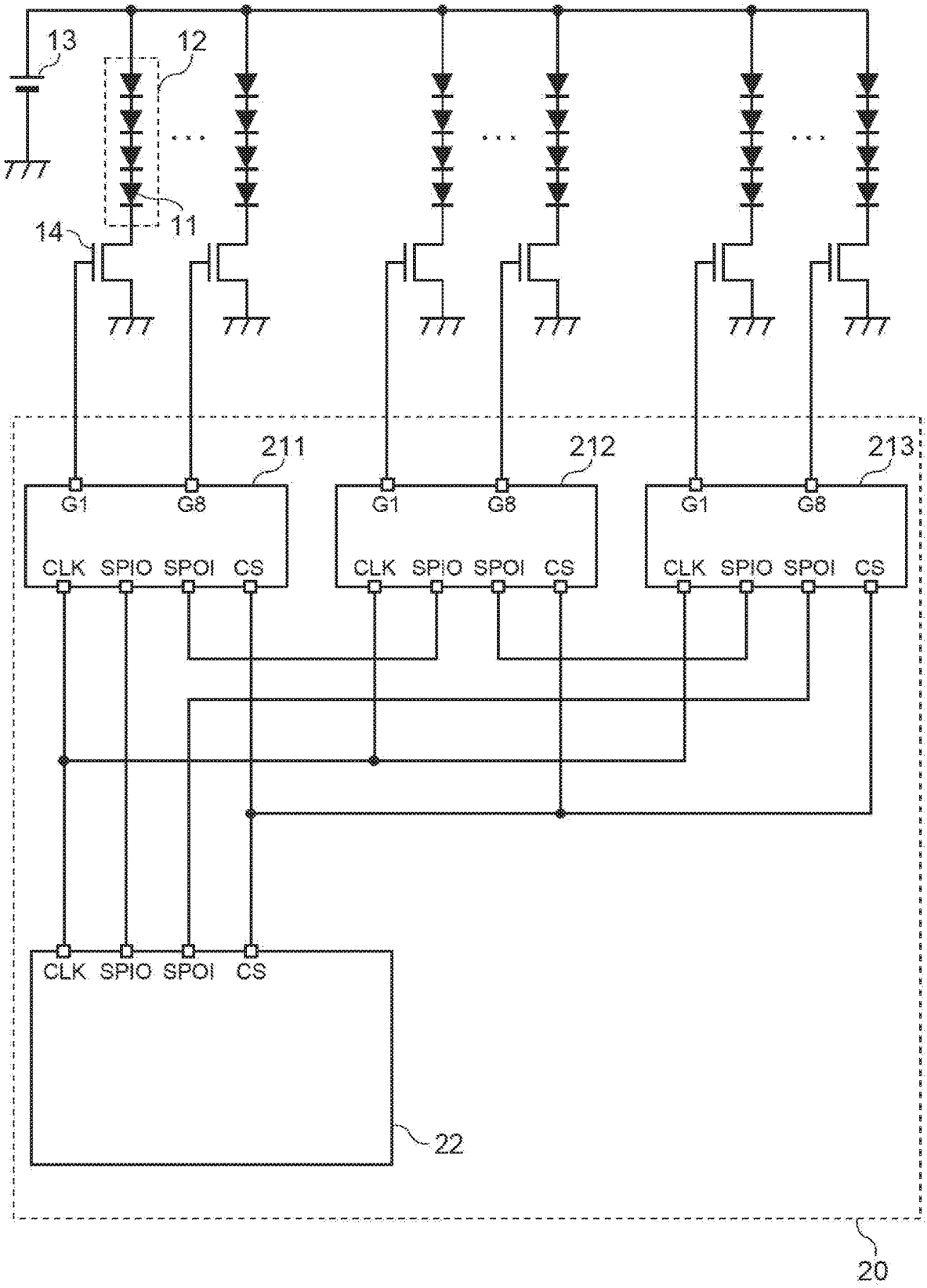
FIG. 2 is a block diagram illustrating a configuration of a backlight driving device 20 according to a first embodiment.

Next, a configuration of a backlight driving device according to a first embodiment will be described. FIG. 2 is a block diagram illustrating a configuration of a backlight driving device 20 according to the first embodiment. As illustrated in FIG. 2, the backlight driving device 20 includes a plurality of drivers 211 to 213 and a control unit 22. Note that in FIG. 2, a case is illustrated in which the backlight driving device 20 includes three drivers 211 to 213, but the number of drivers included in the backlight driving device 20 may be arbitrary so long as it is plural.

The drivers 211 to 213 are cascaded (daisy chain connected). The cascade is a connection method in which a plurality of devices are connected in series, and data is sequentially transferred from a previous stage device to a subsequent stage device. In this example, an SPOI terminal of the driver 211 is connected to an SPIO terminal of the driver 212, and an SPOI terminal of the driver 212 is connected to an SPIO terminal of the driver 213. Moreover, an SPIO terminal of the control unit 22 is connected to an SPIO terminal of the driver 211, and an SPOI terminal of the control unit 22 is connected to an SPOI terminal of the driver 213. The drivers 211 to 213 communicate with the control unit 22 in a Serial Peripheral Interface (SPI). The SPIO terminal and the SPOI terminal of each of the drivers 211 to 213 and the control unit 22 are input/output terminals.

A CLK terminal of the control unit 22 is connected to CLK terminals of the respective drivers 211 to 213. Similarly, a CS terminal of the control unit 22 is connected to CS terminals of the respective drivers 211 to 213.

Four LEDs 11 are serially connected as illustrated in FIG. 1, and one drive unit 12 is constituted by four LEDs 11. Each drive unit 12 is connected to a power supply 13 on an anode side of the LEDs 11 and is connected to a switch 14 on a cathode side. The number of switches 14 provided is the same as the number of the drive unit 12.

ON (conductive state) and OFF (non-conductive state) of the switches 14 are controlled by the drivers 211 to 213. For example, in a case that the switches 14 are n-channel type Field Effect Transistors (FETs), the FETs have drains connected to the cathodes of LEDs 11, sources grounded, and gates connected to G1 to G8 terminals of the drivers 211 to 213. When the switches 14 are turned on, current flows to the LEDs 11 connected to the switches 14 and LEDs 11 emit lights.

The control unit 22 outputs a clock signal from the CLK terminal. The clock signal is input to the CLK terminals of the respective drivers 211 to 213. The clock signal is a signal to adjust the operation timing of the device. The drivers 211 to 213 and the control unit 22 operate in synchronization with the clock signal.

The control unit 22 outputs a Chip Select (CS) signal from the CS terminal. The CS signal is input to the CS terminals of the respective drivers 211 to 213. The CS signal is a signal that the control unit 22 outputs simultaneously with the drive data, and is a signal notifying the respective drivers 211 to 213 of the output of the drive data.

The control unit 22 outputs the drive data from the SPIO terminal or the SPOI terminal. The drive data output from the SPIO terminal of the control unit 22 is input to the SPIO terminal of the driver 211. On the other hand, the drive data output from the SPOI terminal of the control unit 22 is input to the SPOI terminal of the driver 213.

The drive data is data that defines a driving method of the drive unit 12 (LEDs 11) by the drivers 211 to 213. For example, the drive data is data defining a light emission amount of the drive unit 12 (LEDs 11). Specifically, in a case that the drivers 211 to 213 control dimming of the LEDs 11 with Pulse Width Modulation (PWM), the drive data is data defining a duty ratio (a ratio of a time while the driver turns on the switch 14 at a predetermined period). The drive data includes data indicative of the driver to which the drive data is directed.

Each of the drivers 211 to 213, in a case of receiving drive data directed to another driver input from a previous stage, outputs the drive data to a subsequent stage. At this time, each of the drivers 211 to 213, in a case of receiving the drive data directed to another driver input to the SPIO terminal, outputs the drive data from the SPOI terminal. Conversely, each of the drivers 211 to 213, in a case of receiving drive data directed to another driver input to the SPOI terminal, outputs the drive data from the SPIO terminal. In this manner, each of the drivers 211 to 213 bi-directionally performs the operation of transferring drive data directed to another driver as described above in a row of the cascaded drivers 211 to 213.

The control unit 22 may output the drive data from the SPIO terminal, or may output from the SPOI terminal. Accordingly, the order in which the drive data is transferred may be the control unit 22, driver 211, driver 212, and driver 213, or be the control unit 22, driver 213, driver 212, and driver 211.

Figure 3:
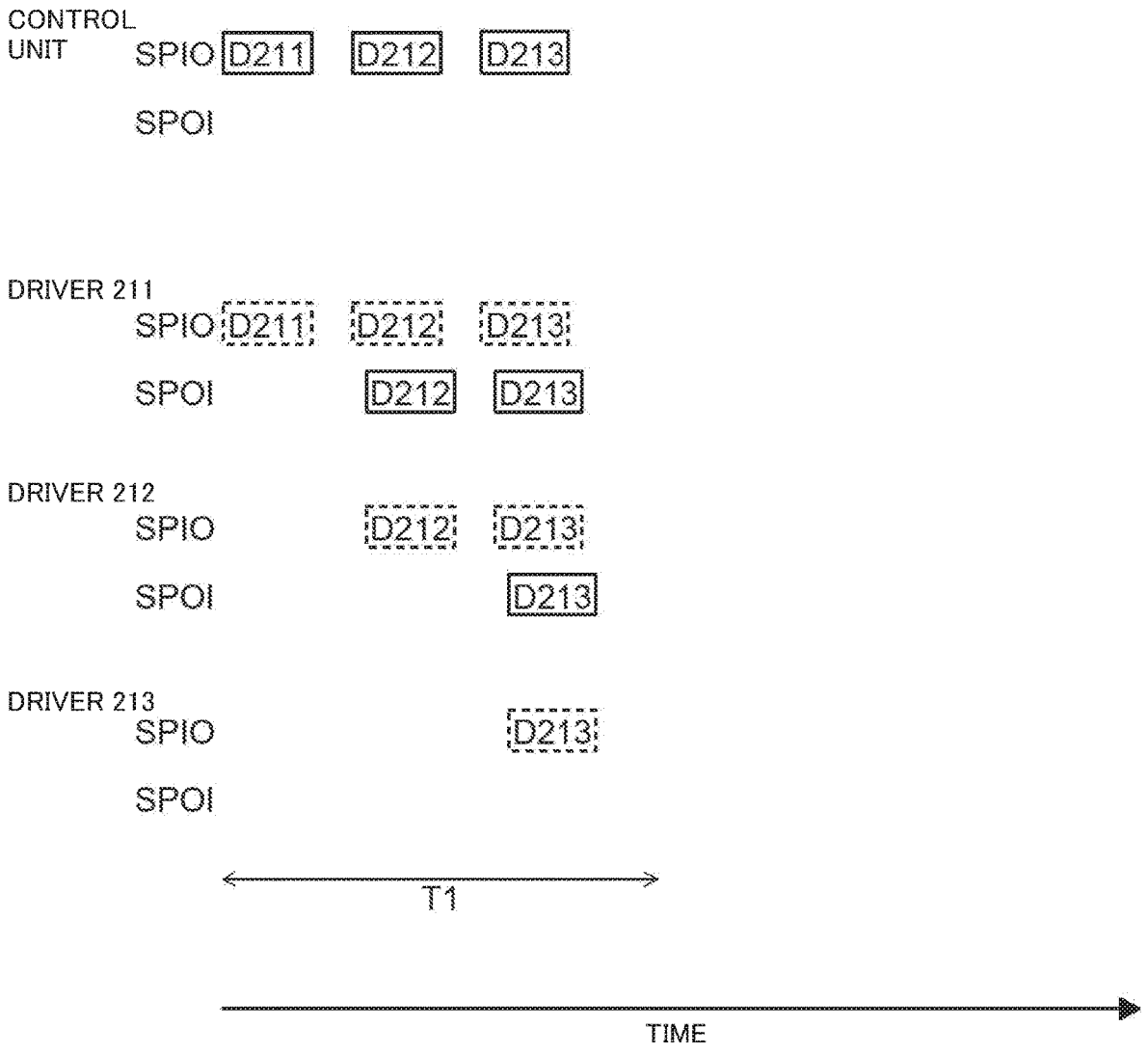
FIG. 3 is a timing chart illustrating an input/output timing of drive data in a case that none of drivers 211 to 213 has abnormalities.

Next, an input/output timing of the drive data in a case that none of the drivers 211 to 213 has abnormalities will be described. FIG. 3 is a timing chart illustrating the input/output timing of the drive data in the case that none of the drivers 211 to 213 has abnormalities. Note that the case that none of the drivers 211 to 213 has abnormalities is a case that each of the drivers 211 to 213 is being capable of driving the drive unit 12. In FIG. 3, solid line rectangles and dashed line rectangles represent the drive data. Each of the solid line rectangles represent the drive data output from the terminal, and each of the dashed line rectangle represents the drive data input to the terminal.

As illustrated in FIG. 3, the control unit 22 sequentially outputs drive data D211 to D213 directed to the drivers 211 to 213, respectively, from the SPIO terminal (period T1). At this time, the control unit 22 also outputs a CS signal indicative of the output of the drive data.

First, the control unit 22 outputs the drive data D211 directed to the driver 211 from the SPIO terminal. The drive data D211 is input to the SPIO terminal of the driver 211. The driver 211 recognizes that the drive data D211 directed to the driver 211 itself is input thereto, based on the drive data D211. As such, the driver 211 does not output the drive data D211 to the subsequent stage, and controls on/off of the switches 14 based on the drive data D211.

Furthermore, the control unit 22 outputs the drive data D212 directed to the driver 212 from the SPIO terminal. The drive data D212 is input to the SPIO terminal of the driver 211. The driver 211 recognizes that the drive data D212 directed to another driver is input thereto, based on the drive data D212. As such, the driver 211 outputs the drive data D212 from the SPOI terminal. The drive data D212 is input to the SPIO terminal of the driver 212. The driver 212 recognizes that the drive data D212 directed to the driver 212 itself is input thereto, based on the drive data D212. As such, the driver 212 does not output the drive data D212 to the subsequent stage, and controls on/off of the switches 14 based on the drive data D212.

Furthermore, the control unit 22 outputs the drive data D213 directed to the driver 213 from the SPIO terminal. The drive data D213 is input to the SPIO terminal of the driver 211. The driver 211 recognizes that the drive data D213 directed to another driver is input thereto, based on the drive data D213. As such, the driver 211 outputs the drive data D213 from the SPOI terminal. The drive data D213 is input to the SPIO terminal of the driver 212. The driver 212 recognizes that the drive data D213 directed to another driver is input thereto, based on the drive data D213. As such, the driver 212 outputs the drive data D213 from the SPOI terminal. The drive data D213 is input to the SPIO terminal of the driver 213. The driver 213 recognizes that the drive data D213 directed to the driver 213 itself is input thereto, based on the drive data D213. As such, the driver 213 does not output the drive data D213 to the subsequent stage, and controls on/off of the switches 14 based on the drive data D213.

Next, an input/output timing of the drive data in a case that at least one of the drivers 211 to 213 has abnormalities will be described. Note that the control unit 22 may determine whether the drivers 211 to 213 have abnormalities in any method. For example, according to a configuration of a second embodiment described below, the control unit 22 may determine whether the drivers 211 to 213 has abnormalities. For example, in a case where the control unit 22 outputs dummy drive data directed to none of the drivers 211 to 213 from the SPIO terminal, and thereafter, the drive data is input to the SPOI terminal of the control unit 22, the control unit 22 may determine that none of the drivers 211 to 213 has abnormalities, and if not, the control unit 22 may determine that at least one of the drivers 211 to 213 has abnormalities.

Figure 4:
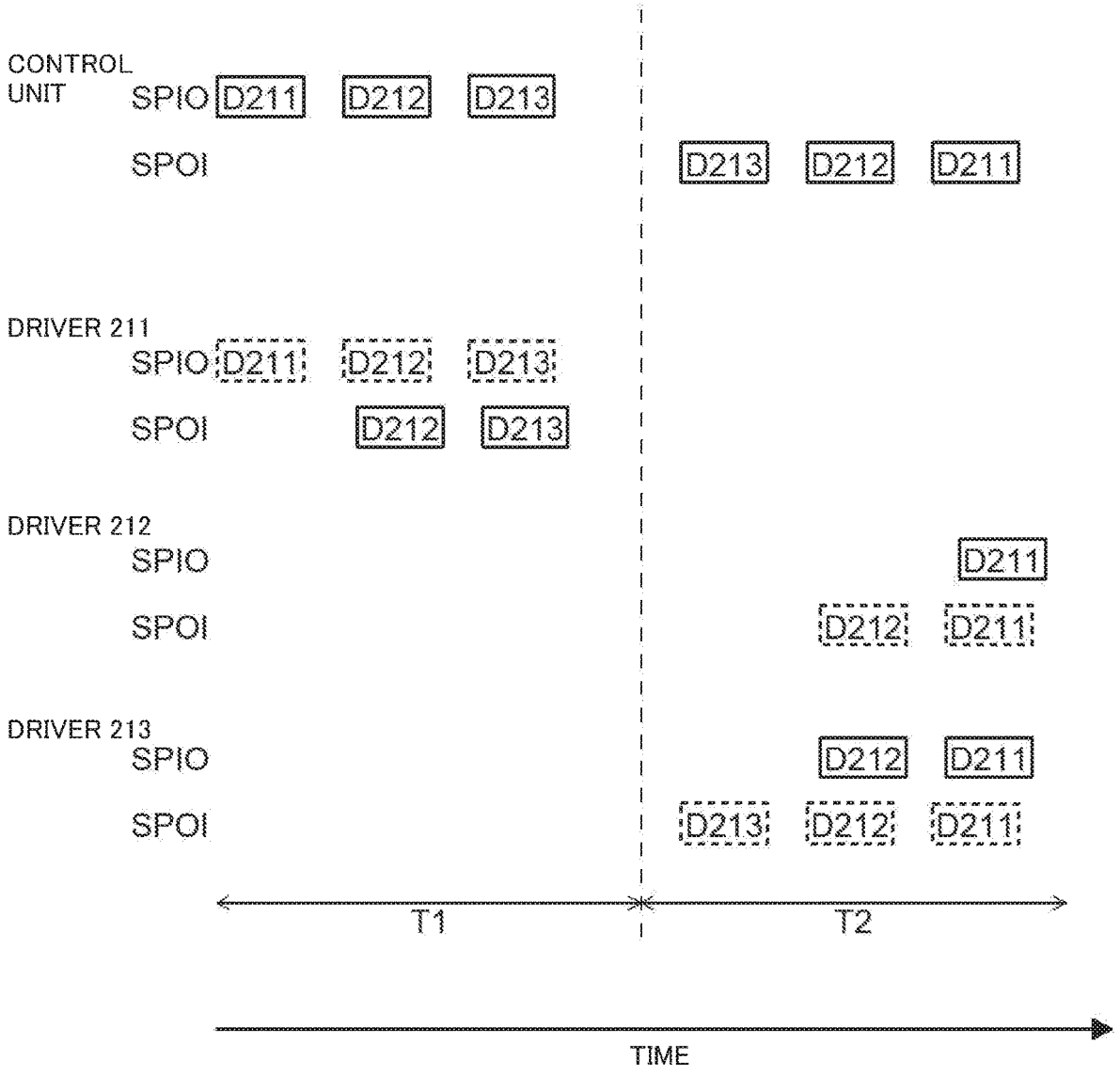
FIG. 4 is a timing chart illustrating an input/output timing of the drive data in a case that at least one of the drivers 211 to 213 has abnormalities.

FIG. 4 is a timing chart illustrating an input/output timing of the drive data in the case that at least one of the drivers 211 to 213 has abnormalities. Note that the case that at least one of the drivers 211 to 213 has abnormalities is a case that at least one of the drivers 211 to 213 is incapable of driving the drive unit 12. FIG. 4 illustrates a case that a faulty portion (for example, a connection failure of wiring connecting both terminals) is present between the SPOI terminal of the driver 211 and the SPIO terminal of the driver 212. In FIG. 4, the drive data is displayed in the same display method as that illustrated in FIG. 3.

As illustrated in FIG. 4, similarly to the case that none of the drivers 211 to 213 has abnormalities, the control unit 22 sequentially outputs drive data D211 to D213 directed to the drivers 211 to 213, respectively, from the SPIO terminal (period T1). At this time, the control unit 22 also outputs a CS signal indicative of the output of the drive data.

However, because a faulty portion is present between the SPOI terminal of the driver 211 and the SPIO terminal of the driver 212, the drive data is not input to the SPIO terminal of the driver 212. Thus, no drive data is input to the driver 212 and the driver 213 as the subsequent stage of the driver 212, and each of the drivers 212 and 213 is incapable of driving the drive unit 12.

Next, the control unit 22 sequentially outputs the drive data D211 to D213 directed to the drivers 211 to 213, respectively, from the SPOI terminal (period T2). At this time, the control unit 22 also outputs a CS signal indicative of the output of the drive data.

First, the control unit 22 outputs the drive data D213 directed to the driver 213 from the SPOI terminal. The drive data D213 is input to the SPOI terminal of the driver 213. The driver 213 recognizes that the drive data D213 directed to the driver 213 itself is input thereto, based on the drive data D213. As such, the driver 213 does not output the drive data D213 to the subsequent stage, and controls on/off of the switches 14 based on the drive data D213.

Furthermore, the control unit 22 outputs the drive data D212 directed to the driver 212 from the SPOI terminal. The drive data D212 is input to the SPOI terminal of the driver 213. The driver 213 recognizes that the drive data D212 directed to another driver is input thereto, based on the drive data D212. As such, the driver 213 outputs the drive data D212 from the SPIO terminal. The drive data D212 is input to the SPOI terminal of the driver 212. The driver 212 recognizes that the drive data D212 directed to the driver 212 itself is input thereto, based on the drive data D212. As such, the driver 212 does not output the drive data D212 to the subsequent stage, and controls on/off of the switches 14 based on the drive data D212.

Furthermore, the control unit 22 outputs the drive data D211 directed to the driver 211 from the SPOI terminal. The drive data D211 is input to the SPOI terminal of the driver 213. The driver 213 recognizes that the drive data D211 directed to another driver is input thereto, based on the drive data D211. As such, the driver 213 outputs the drive data D211 from the SPIO terminal. The drive data D211 is input to the SPOI terminal of the driver 212. The driver 212 recognizes that the drive data D211 directed to another driver is input thereto, based on the drive data D211. As such, the driver 212 outputs the drive data D211 from the SPIO terminal. However, in this example, because a faulty portion is present between the SPOI terminal of the driver 211 and the SPIO terminal of the driver 212, the drive data D211 is not input to the SPOI terminal of the driver 211. Thus, no drive data is input to the driver 211, and the driver 211 is incapable of driving the drive unit 12.

As described above, in the first embodiment, in the case that at least one of the drivers 211 to 213 has abnormalities, the control unit 22 outputs the drive data D211 to D213 directed to the drivers 211 to 213, respectively, to the driver 211 located at one end of the drivers 211 to 213, and thereafter, outputs to the driver 213 located at the other end of the drivers 211 to 213. This allows the drive data D211 to D213 to be provided to as many drivers 211 to 213 as possible even if a portion of the cascaded drivers 211 to 213 cannot transfer the drive data. Accordingly, as many LEDs 11 as possible can be driven to suppress degradation of display quality in the display device.

In the first embodiment, each of the drivers 211 to 213 includes the SPIO terminal and the SPOI terminal that are input/output terminals. As such, each of the drivers 211 to 213 can transfer the drive data bi-directionally in a simple configuration with two input/output terminals.

In the first embodiment, in the case that none of the drivers 211 to 213 has abnormalities, the control unit 22 inputs the drive data D211 to D213 directed to the drivers 211 to 213, respectively, only to the driver 211. Thus, in the case that the drivers 211 to 213 do not need to transfer the drive data bi-directionally, the drivers 211 to 213 transfer the data only in one direction, so the operation in this case can be simplified.

In the first embodiment, in the case that the drivers 211 to 213 receive the drive data D211 to D213 directed to the drivers 211 to 213 themselves, respectively, input from the previous stage, the drivers 211 to 213 do not output the drive data D211 to D213 to the subsequent stage. Thus, in the drivers 211 to 213, unnecessary data can be prevented from being output to the subsequent stage to suppress power consumption in the drivers 211 to 213 and suppress malfunctions of the drivers 211 to 213.

Note that not only in the case that at least one of the drivers 211 to 213 has abnormalities but also in the case that none of the drivers 211 to 213 has abnormalities, the control unit 22 may input the drive data D211 to D213 directed to the drivers 211 to 213, respectively, to the driver 211, and thereafter, to the driver 213. With such a configuration, the control unit 22 can provide the drive data D211 to D213 to as many drivers 211 to 213 as possible without being required to detect the abnormalities of the drivers 211 to 213.

The control unit 22, during the period T2, may output the same drive data as the drive data D211 to D213 output in the period T1, or may output the drive data to be output next to the drive data D211 to D213 output in the period T1.

Second Embodiment

Next, a second embodiment will be described. Note that, in the following description, in a case that the same reference numerals as in the first embodiment are used, the same configuration as in the first embodiment is illustrated, and reference is made to the preceding description unless otherwise described. Hereinafter, differences, in the second embodiment, from the first embodiment will be described, and description of a similar configuration will be omitted.

Figure 5:
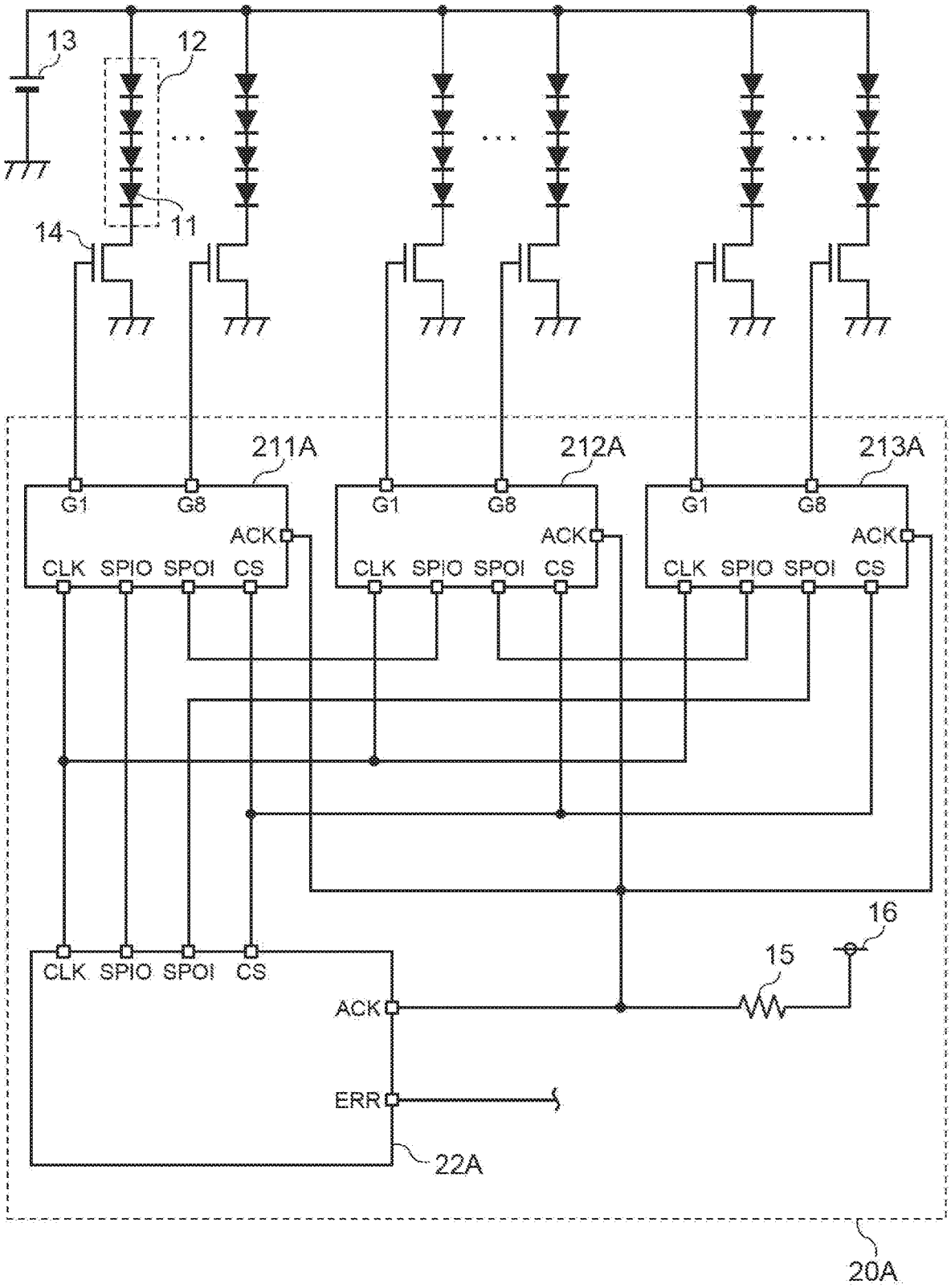
FIG. 5 is a block diagram illustrating a configuration of a backlight driving device 20A according to a second embodiment.

The second embodiment relates to a configuration for detecting an abnormality of a driver. FIG. 5 is a block diagram illustrating a configuration of a backlight driving device 20A according to the second embodiment. As illustrated in FIG. 5, each of drivers 211A to 213A and a control unit 22A included in the backlight driving device 20A includes an ACK terminal. The ACK terminal of the control unit 22A is connected to one end of a pull-up resistor 15, and the other end of the resistor 15 is connected to a voltage source 16. Furthermore, a connection node of the ACK terminal of the control unit 22A and the resistor 15 is connected to ACK terminals of the respective drivers 211A to 213A. The control unit 22A includes an ERR terminal.

Each of drivers 211A to 213A internally couples the ACK terminal to a ground potential in a case of receiving drive data directed to itself input thereto, and internally opens the ACK terminal while other periods. For example, each of the drivers 211A to 213A includes therein a switch (for example, a transistor) that controls whether to connect the ACK terminal to the ground potential, and thereby, turns on the switch to connect the ACK terminal to the ground potential, and turns off the switch to open the ACK terminal.

Figure 6:
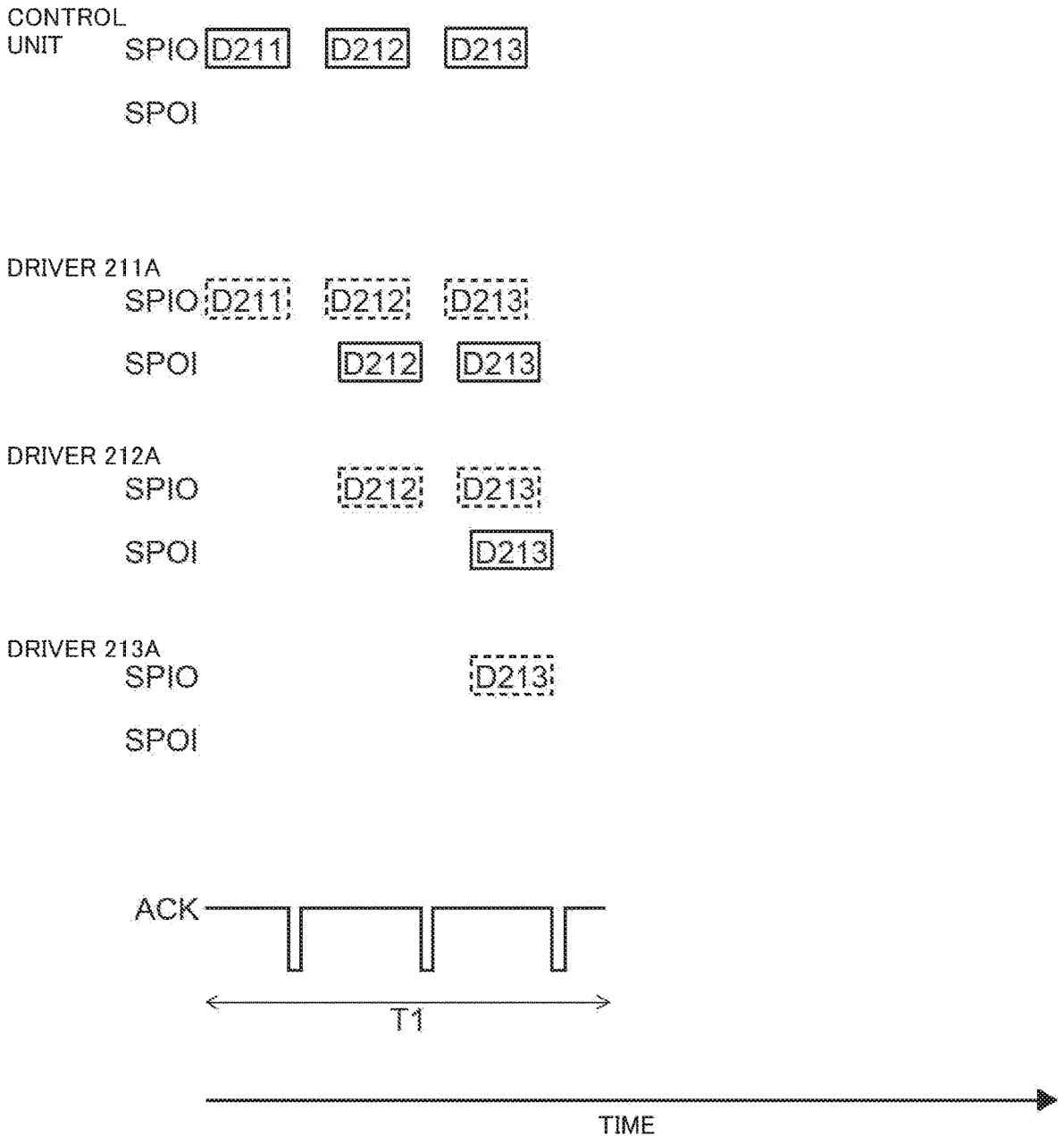
FIG. 6 is a timing chart illustrating an input/output timing of drive data and a voltage variation of an ACK terminal in a case that none of drivers 211A to 213A has abnormalities.

Next, an input/output timing of the drive data in a case that none of the drivers 211A to 213A has abnormalities will be described. FIG. 6 is a timing chart illustrating an input/output timing of the drive data and a voltage variation of the ACK terminal in the case that none of drivers 211A to 213A has abnormalities.

As illustrated in FIG. 6, the control unit 22A sequentially outputs the drive data D211 to D213 directed to the drivers 211 to 213, respectively, from the SPIO terminal (period T1), similarly to the first embodiment (see FIG. 3). At this time, the control unit 22 also outputs a CS signal indicative of the output of the drive data.

However, in the second embodiment, when the drivers 211 to 213 receive the drive data D211 to D213 input, respectively, that are directed to themselves, the drivers 211 to 213 provide notifications to the control unit 22A. Specifically, each of the drivers 211 to 213 couples the ACK terminal to the ground potential at a timing when the input of the drive data D211 to D213 directed to themselves is completed. Then, the control unit 22A, in a case of outputting the respective drive data D211 to D213, detects whether a voltage of the ACK terminal has dropped to a predetermined voltage value or lower (low level).

Hereinafter, the control unit 22A detecting the low level of the ACK voltage in a case of outputting the drive data D211 is described as "detecting a notification from the driver 211A". Similarly, the control unit 22A detecting the low level of the ACK voltage in a case of outputting the drive data D212 is described as "detecting a notification from driver 212A," and the control unit 22A detecting the low level of the ACK voltage in a case of outputting the drive data D213 is described as "detecting a notification from driver 213A".

When the control unit 22A detects the notifications from all of the drivers 211A to 213A in a case of outputting the respective drive data D211 to D213, the control unit 22A determines that the backlight driving device 20A has no abnormality. On the other hand, when the control unit 22A fails to detect the notification from at least one of the drivers 211A to 213A in a case of outputting the respective drive data D211 to D213, the control unit 22A determines that at least one of the drivers 211A to 213A has abnormalities.

Figure 7:
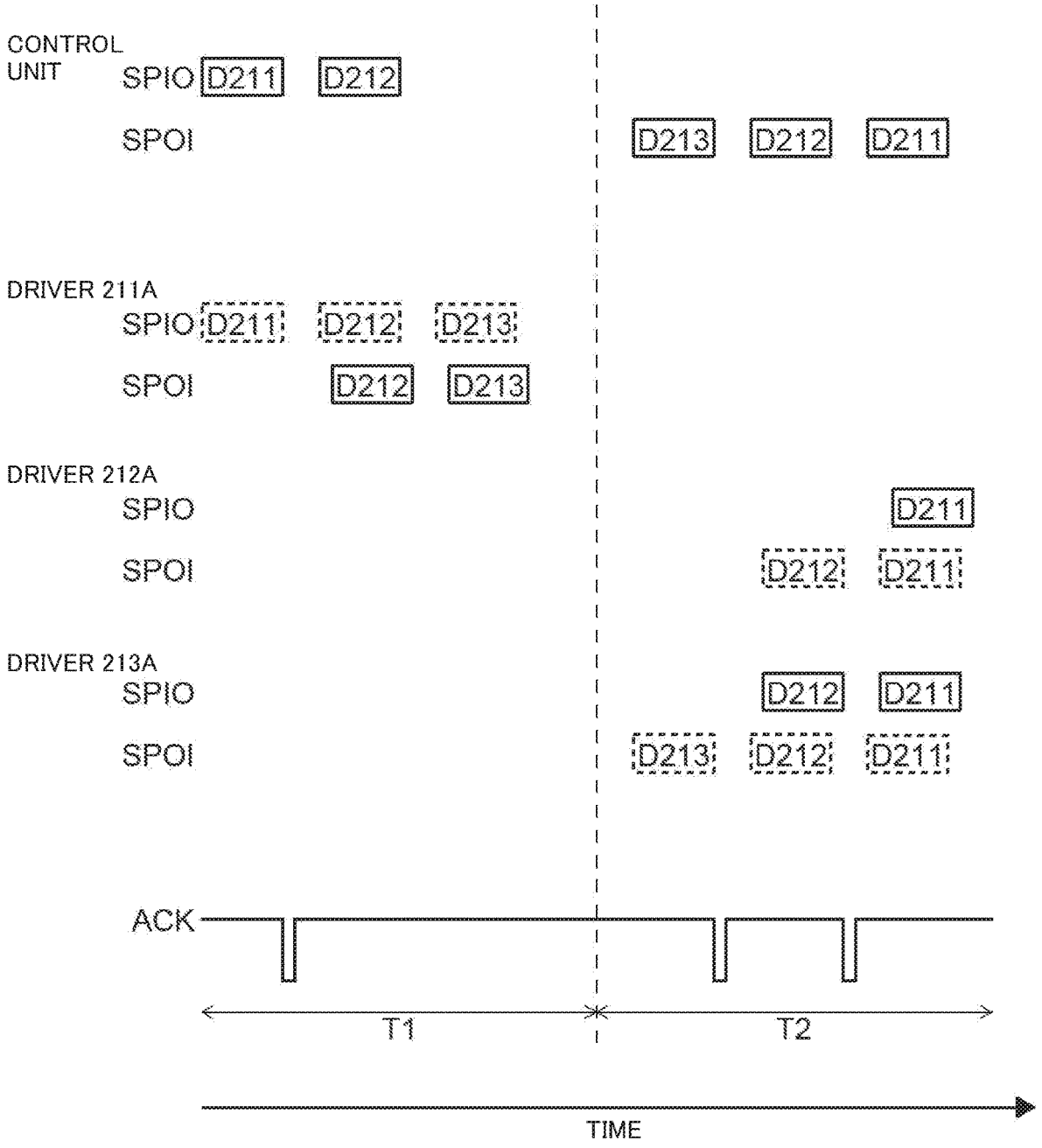
FIG. 7 is a timing chart illustrating an input/output timing of the drive data and a voltage variation of the ACK terminal in a case that at least one of the drivers 211A to 213A has abnormalities.

Next, an input/output timing of the drive data in a case that at least one of the drivers 211A to 213A has abnormalities will be described. FIG. 7 is a timing chart illustrating an input/output timing of the drive data and a voltage variation of the ACK terminal in the case that at least one of the drivers 211A to 213A has abnormalities. Note that FIG. 7 illustrates a case that a faulty portion is present between the SPOI terminal of the driver 211A and the SPIO terminal of the driver 212A, similarly to FIG. 4.

As illustrated in FIG. 7, similarly to the case that none of the drivers 211A to 213A has abnormalities, the control unit 22A sequentially outputs drive data D211 to D213 directed to the drivers 211A to 213A, respectively, from the SPIO terminal (period T1). At this time, the control unit 22A also outputs a CS signal indicative of the output of the drive data.

In the example illustrated in FIG. 7, the drive data is input to the driver 211A, but no drive data is input to the drivers 212A and 213A. Thus, the control unit 22A detects a notification from the driver 211A, but detects no notification from each of the drivers 213A and 212A. This allows the control unit 22A to determine that at least one of the drivers 211A to 213A has abnormalities.

Then, the control unit 22A sequentially outputs the drive data D211 to D213 directed to the drivers 211A to 213A, respectively, from the SPOI terminal (period T2), similarly to the first embodiment (see FIG. 4). At this time, the control unit 22A also outputs a CS signal indicative of the output of the drive data.

In the example illustrated in FIG. 7, the drive data is input to the drivers 213A and 212A, but no drive data is input to the driver 211A. Thus, the control unit 22A detects a notification from each of the drivers 213A and 212A, but detects no notification from the driver 211A.

The control unit 22A outputs, from the ERR terminal, error data representing whether a notification is received from each of the drivers 211A to 213A. For example, a host of the display device identifies a faulty portion, based on this error data. Hereinafter, a method for identifying a faulty portion will be described with reference to FIG. 8. FIG. 8 is a table illustrating the method for identifying a faulty portion, based on the error data. Note that the error data illustrated in FIG. 8 is data representing whether the control unit 22A detects a notification from each of the drivers 211A to 213A in each of the periods T1 and T2. In FIG. 8, a check mark indicates a driver from which the control unit 22A detects a notification, and a cross mark represents a driver from which the control unit 22A does not detect a notification. In addition, a hyphen mark for the period T2 indicates that the control unit 22A does not output the drive data D211 to D213.

As illustrated in FIG. 8, error data E1 is data in a case that the control unit 22A detects notifications from all of the drivers 211 to 213 in the period T1. The error data E1 indicates that none of the drivers 211A to 213A has abnormalities.

Error data E2 is data in a case that the control unit 22A detect notifications from none of the drivers 211A to 213A in the both periods T1 and T2. The error data E2 indicates that a faulty portion is present in the main wiring that transmits a common signal. Note that the common signal is a signal input in common to the respective drivers 211A to 213A, such as a clock signal or a CS signal. The main wiring is a wiring common to the drivers 211A to 213A before branching into branch lines, which are wirings connected to the respective drivers 211A to 213A.

Error data E3 is data in a case that the control unit 22A detects notifications from none of the drivers 211A to 213A in the period T1, and detects notifications from the drivers 212A and 213A but not from the driver 211 in the period T2. The error data E3 indicates that a faulty portion is present in the branch line of the common signal connected to the driver 211A or that the driver 211A itself is failed.

Error data E4 is data in a case that the control unit 22A detects notifications from the driver 211A but not from the drivers 212A and 213A in the period T1, and detects notifications from the driver 213A but not from the drivers 211A and 212A in the period T2. The error data E4 indicates that a faulty portion is present in the branch line of the common signal connected to the driver 212A or that the driver 212A itself is failed.

Error data E5 is data in a case that the control unit 22A detects notifications from the drivers 211A and 212A but not from the driver 213A in the period T1, and detects notifications from none of the drivers 211A to 213A in the period T2. The error data E5 indicates that a faulty portion is present in the branch line of the common signal connected to the driver 213A or that the driver 213A itself is failed.

Error data E6 is data in a case that the control unit 22A detects notifications from none of the drivers 211A to 213A in the period T1, and detects notifications from all of the drivers 211A to 213A in the period T2. The error data E6 indicates that a faulty portion is present between the SPIO terminal of the control unit 22A and the SPIO terminal of the driver 211A.

Error data E7 is data in a case that the control unit 22A detects notifications from the driver 211A but not from the drivers 212A and 213A in the period T1, and detects notifications from the drivers 212A and 213A but not from the driver 211A in the period T2. The error data E7 indicates that a faulty portion is present between the SPIO terminal of the driver 211A and the SPIO terminal of the driver 212A.

Error data E8 is data in a case that the control unit 22A detects notifications from the drivers 211A and 212A but not from the driver 213A in the period T1, and detects notifications from the drivers 213A but not from the drivers 211A and 212A in the period T2. The error data E8 indicates that a faulty portion is present between the SPIO terminal of the driver 212A and the SPIO terminal of the driver 213A.

As described above, in the second embodiment, when the drivers 211A to 213A receive the drive data D211 to D213 input, respectively, that are directed to themselves, the drivers 211A to 213A provide notifications to the control unit 22A. Therefore, the control unit 22A can determine that at least one of the drivers 211A to 213A has abnormalities, based on whether notifications are received from the drivers 211A to 213A.

In the second embodiment, the control unit 22A outputs the error data representing whether a notification is received from each of the drivers 211A to 213A. Thus, the host of the display device or the like, for example, can identify a faulty portion, based on this error data.

Note that the control unit 22A may be configured to include the ACK terminals the number of which is the same as the number of drivers 211A to 213A, in which the ACK terminals are individually connected to the respective ACK terminals of the drivers 211A to 213A. However, with the configuration illustrated in FIG. 5, the control unit 22A includes one ACK terminal and the wirings connected to the ACK terminal is common, so the terminals and wiring of the control unit 22A can be simplified.

The control unit 22A may identify the faulty portion, based on the detection result of the voltage of the ACK terminal. Furthermore, the control unit 22A may output the error data indicating the identified faulty portion from the ERR terminal.

Third Embodiment

Next, a third embodiment will be described. Note that, in the following description, in a case that the same reference numerals as in the first or second embodiment are used, the same configuration as in the first or second embodiment is illustrated, and reference is made to the preceding description unless otherwise described. Hereinafter, differences, in the third embodiment, from the first or second embodiment will be described, and description of a similar configuration will be omitted. One driver 211B is described as an example below, but other drivers than the driver 211B are the same as the driver 211B.

Figure 9:
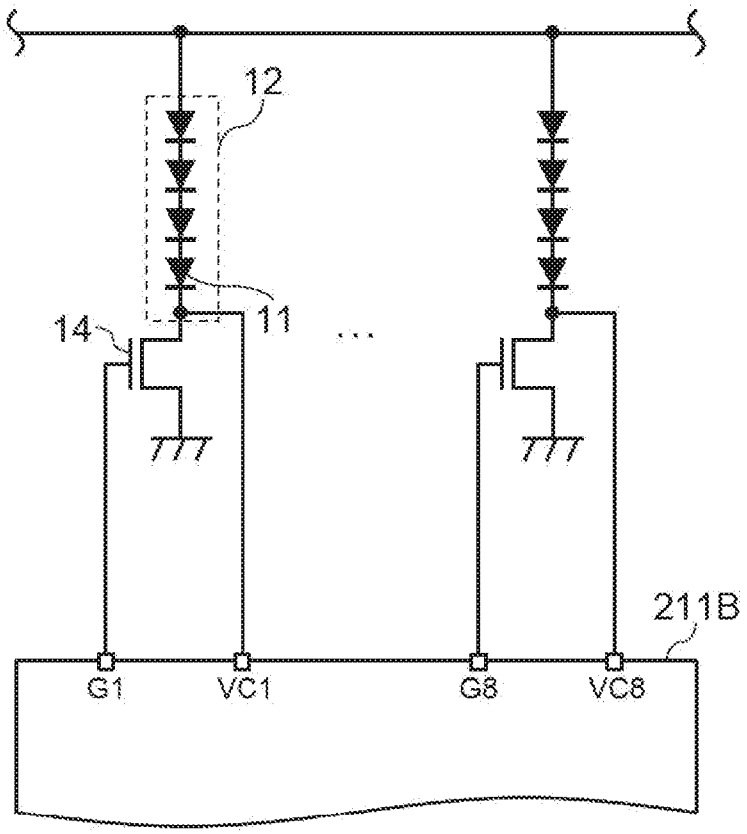
FIG. 9 is a block diagram illustrating a configuration of a driver 211B included in a backlight driving device according to a third embodiment.

The third embodiment relates to a configuration for detecting an abnormality of the drive unit 12. FIG. 9 is a block diagram illustrating a configuration of the driver 211B included in a backlight driving device according to the third embodiment. As illustrated in FIG. 9, the driver 211B includes VC1 to VC8 terminals to each of which a voltage of the connection node between the LEDs 11 and the switch 14 is input. The VC1 to VC8 terminals, the number of which is the same as the number of drive units 12 controlled by the driver 211B, each receive the voltage input of an end on the cathode side of the drive unit 12.

Figure 10:
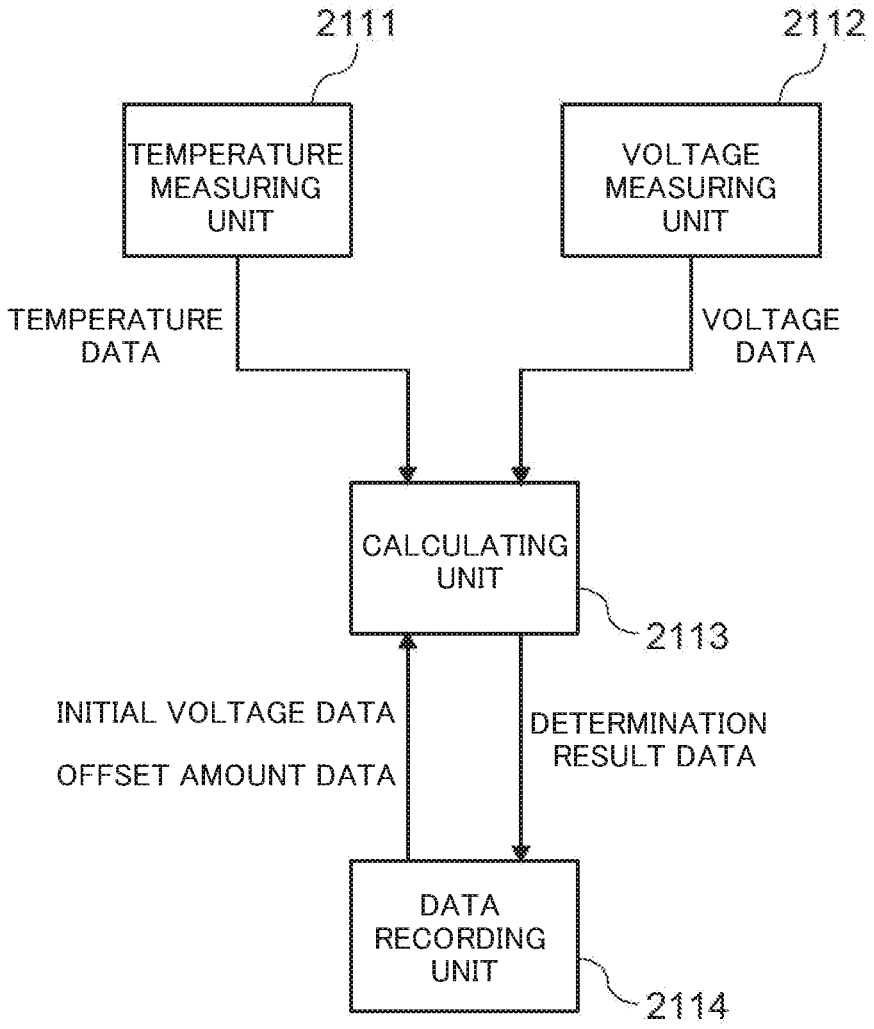
FIG. 10 is a block diagram illustrating an internal configuration of the driver 211B.

Next, an internal configuration of the driver 211B will be described. FIG. 10 is a block diagram illustrating the internal configuration of the driver 211B. As illustrated in FIG. 10, the driver 211B includes a temperature measuring unit 2111, a voltage measuring unit 2112, a calculating unit 2113, and a data recording unit 2114.

The temperature measuring unit 2111 measures a temperature of a portion where the LED 11 is located. The voltage measuring unit 2112 measures the voltage of each of the VC1 to VC8 terminals. The calculating unit 2113 determines whether the drive unit 12 has abnormalities, based on the measurement results of the temperature measuring unit 2111 and the voltage measuring unit 2112, and data recorded by the data recording unit 2114. The data recording unit 2114 records the data required for the calculation by the calculating unit 2113.

The temperature measuring unit 2111 includes a temperature detection device having a temperature sensor such as a thermistor, for example. The voltage measuring unit 2112 includes, for example, an AD converter. The calculating unit 2113 includes a calculating device such as a microprocessor, for example. The data recording unit 2114 includes a recording device such as a semiconductor memory, for example.

The data recording unit 2114 records initial voltage data and offset amount data. The initial voltage data is data obtained by measuring the voltage of each of the VC1 to VC8 terminals when the switch 14 is turned on to drive the LEDs 11 (emit light) at the time of shipment of the display device or backlight. That is, the initial voltage data is data representing a voltage value input to each of the VC1 to VC8 terminals in the case that the drive unit 12 has no abnormality. The offset amount data is data representing a temperature characteristic of a forward voltage (Vf) of the LED 11.

The calculating unit 2113 estimates the voltage of each of the VC1 to VC8 terminals by applying an offset amount calculated based on the offset amount data and the measurement results of the temperature measuring unit 2111 to the voltage value represented by the initial voltage data. The calculating unit 2113 determines whether the drive unit 12 has abnormalities by comparing the estimated voltage value with the voltage value measured by the voltage measuring unit 2112.

For example, in a case where there is a terminal in the VC1 to VC8 terminals that a difference between the estimated voltage value and the voltage value measured by the voltage measuring unit 2112 is equal to or greater than a predetermined threshold, the calculating unit 2113 determines that the drive unit 12 connected to the terminal has abnormalities. Note that in the case that the calculating unit 2113 determines that the drive unit 12 has abnormalities, in a case where the voltage value measured by the voltage measuring unit 2112 is greater than the estimated voltage value, the calculating unit 2113 may determine that the LED 11 included in the drive unit 12 has a short circuit failure. In the case that the calculating unit 2113 determines that the drive unit 12 has abnormalities, in a case that the measurement result of the voltage measuring unit 2112 is floating, it may be determined that the LED 11 included in the drive unit 12 has an open failure.

Then, the calculating unit 2113 generates determination result data representing the determination result obtained as described above. The determination result data is recorded in the data recording unit 2114. Note that the driver 211B may output the determination result data to the control unit 22, the host of the display device, or the like.

As described above, in the third embodiment, the driver 211B measures the voltage of the end on the cathode side of the drive unit that the driver 211B drives itself. With this configuration, the driver 211B can detect whether the drive unit 12 driven by the driver 211B itself has abnormalities, based on the voltage of the end.

Note that the driver 211B may determine whether the drive unit 12 has abnormalities only by comparing the voltage measured at each of the VC1 to VC8 terminals with a predetermined threshold voltage. In this case, the driver 211B can determine whether the drive unit 12 has abnormalities by a simple calculation. This threshold voltage may be determined based on the voltage of each of the VC1 to VC8 terminals measured when the switch 14 is turned on at the time of shipment of the display device or backlight 10. In this case, the driver 211B can accurately determine whether the drive unit 12 has abnormalities in consideration of variation in the forward voltage of the LED 11.

However, in the case of the configuration illustrated in FIG. 10, the driver 211B determines whether the drive unit 12 has abnormalities in consideration also of variation in the forward voltage of the LED 11 due to an ambient temperature. Therefore, even when the backlight driving device is used in an environment where the variation in the ambient temperature is large, such as in a meter panel of an automobile, it is possible to determine with high accuracy whether the drive unit 12 has abnormalities.

The driver 211B may also be configured to output data representing the measured voltage only by measuring the voltage of the drive unit 12. In this case, whether the drive unit 12 has abnormalities may be determined based on the data in the control unit 22, the host of the display device or the like.

Fourth Embodiment

Next, a fourth embodiment will be described. Note that, in the following description, in a case that the same reference numerals as in the first to third embodiments are used, the same configurations as in the first to third embodiments are illustrated, and reference is made to the preceding description unless otherwise described. Hereinafter, differences, in the fourth embodiment, from the first to third embodiments will be described, and description of a similar configuration will be omitted.

Figure 11:
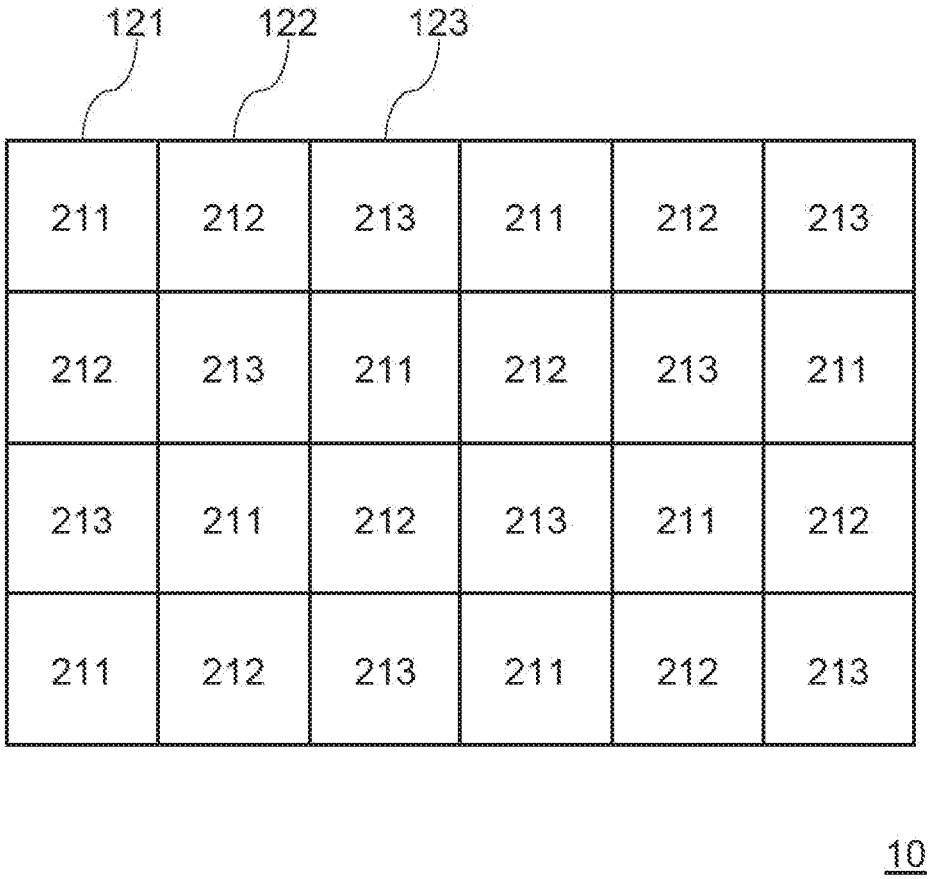
FIG. 11 is a schematic view of the backlight 10 illustrating an arrangement of drive units 121 to 123 driven by the drivers 211 to 213, respectively.

The fourth embodiment relates to an arrangement of the drive units. FIG. 11 is a schematic view of the backlight 10 illustrating the arrangement of the drive units driven by the respective drivers 211 to 213. Note that in FIG. 11, drive units 121 driven by the driver 211 are denoted by "211" inside blocks thereof. Drive units 122 driven by the driver 212 are denoted by "212" inside blocks thereof. Drive units 123 driven by the driver 213 are denoted by "213" inside blocks thereof.

As illustrated in FIG. 11, any two longitudinally adjacent drive units are driven by different drivers and any two laterally adjacent drive units are driven by different drivers.

The drive units arranged in a right-upward (left-downward) diagonal direction are driven by the same driver.

Figure 12:
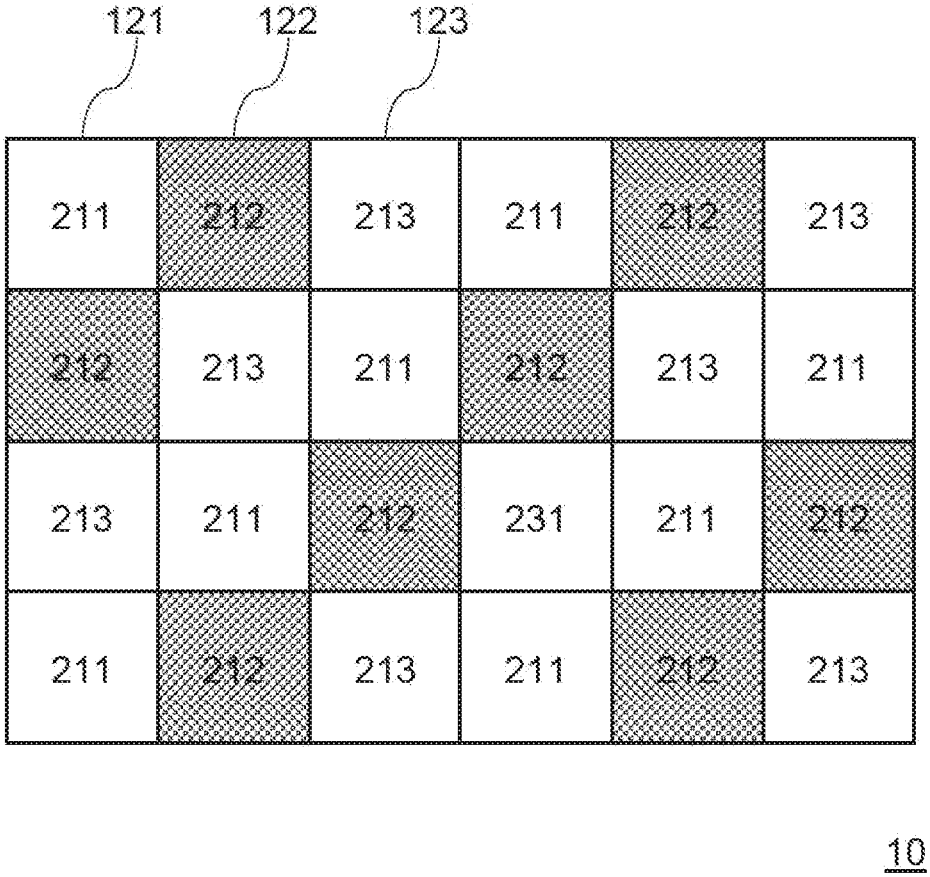
FIG. 12 is a schematic view of the backlight 10 in a case that the driver 212 has an abnormality.

FIG. 12 is a schematic view of the backlight 10 in a case that the driver 212 has an abnormality. As illustrated in FIG. 12, the drive units 122 are incapable of being driven because the driver 212 has an abnormality. In FIG. 12, the drive units 122 incapable of being driven are cross-hatched. Note that, when a configuration similar to that of the first embodiment described above is employed, even if the driver 212 has an abnormality with the drivers 211 to 213 being cascaded, the drivers 211 and 213 can drive the drive units 121 and 123, for example.

As illustrated in FIG. 12, the drive units 122 incapable of being driven are not adjacent to each other in the longitudinal and lateral directions. The drive units 121 and 123 adjacent to the drive units 122 in the longitudinal and lateral directions are driven by the drivers 211 and 213, respectively.

As described above, in the fourth embodiment, any two longitudinally adjacent drive units are driven by two different drivers and any two laterally adjacent drive units are driven by two different drivers. Thus, even if a specific driver 212 has abnormalities, the drive units 122 caused thereby to be incapable of being driven are not adjacent to each other in the longitudinal and lateral directions, and are not congregated. Accordingly, it is possible to suppress degradation of the display quality in the display device.

Note that the drivers 211 to 213 may not be cascaded. In this case, the drive data may be configured to be input from the control unit or the like to each of the drivers 211 to 213.

The drive units driven by the same driver may be drive units arranged in the right-downward (left-upward) diagonal direction, or may be drive units arranged in another manner.

Fifth Embodiment

Next, a fifth embodiment will be described. Note that, in the following description, in a case that the same reference numerals as in the first to fourth embodiments are used, the same configurations as in the first to fourth embodiments are illustrated, and reference is made to the preceding description unless otherwise described. Hereinafter, differences, in the fifth embodiment, from the first to fourth embodiments will be described, and description of a similar configuration will be omitted.

Figure 13:
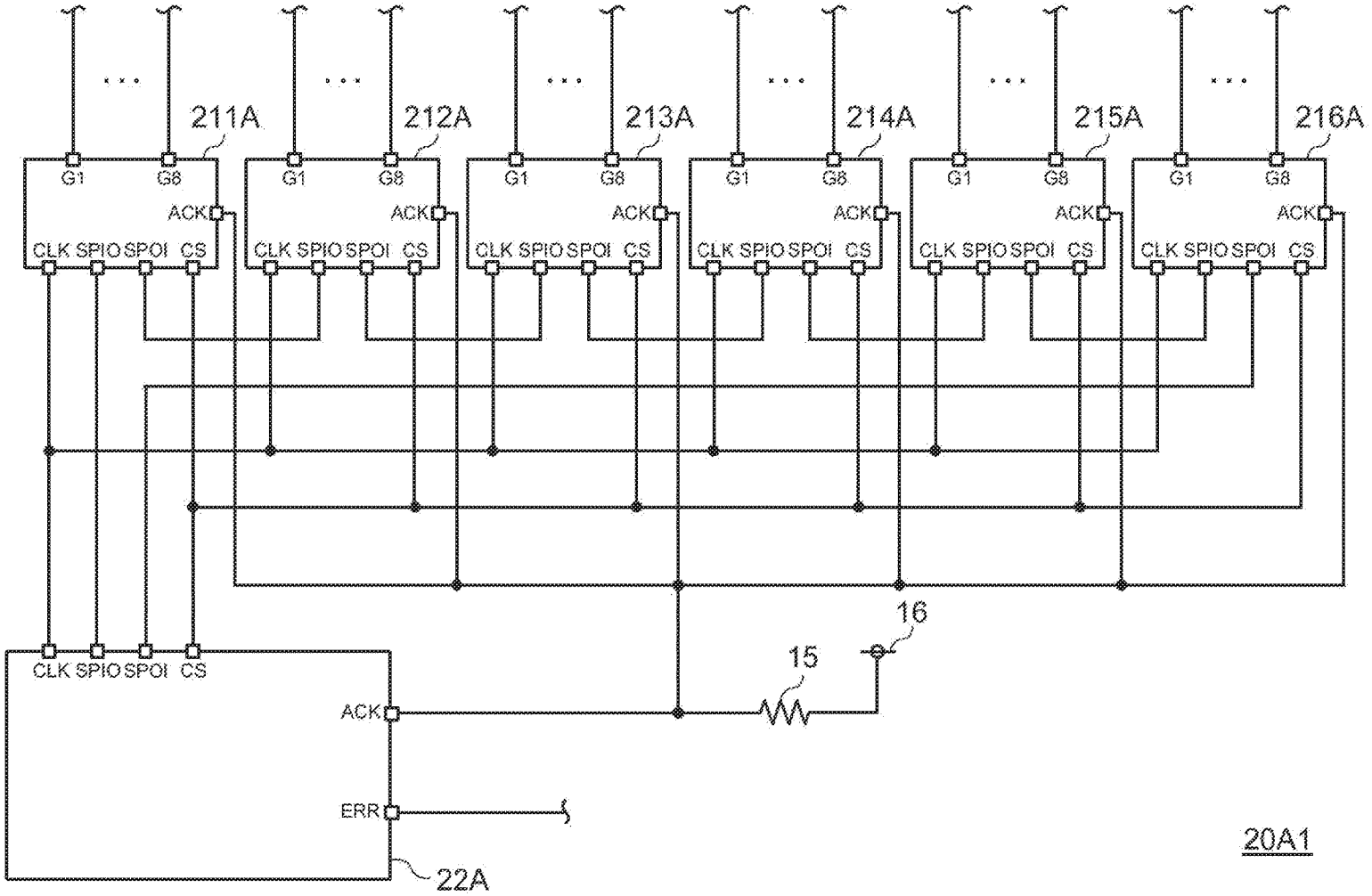
FIG. 13 is a block diagram illustrating a configuration of a backlight driving device 20A1 according to a fifth embodiment.

The fifth embodiment relates to a driving method of another driver in a case that a specific driver has an abnormality. FIG. 13 is a block diagram illustrating a configuration of a backlight driving device 20A1 according to the fifth embodiment. As illustrated in FIG. 13, the backlight driving device 20A1 is configured similar to the backlight driving device 20A illustrated in FIG. 5, except that the backlight driving device 20A1 includes six drivers 211A to 216A.

Figure 14:
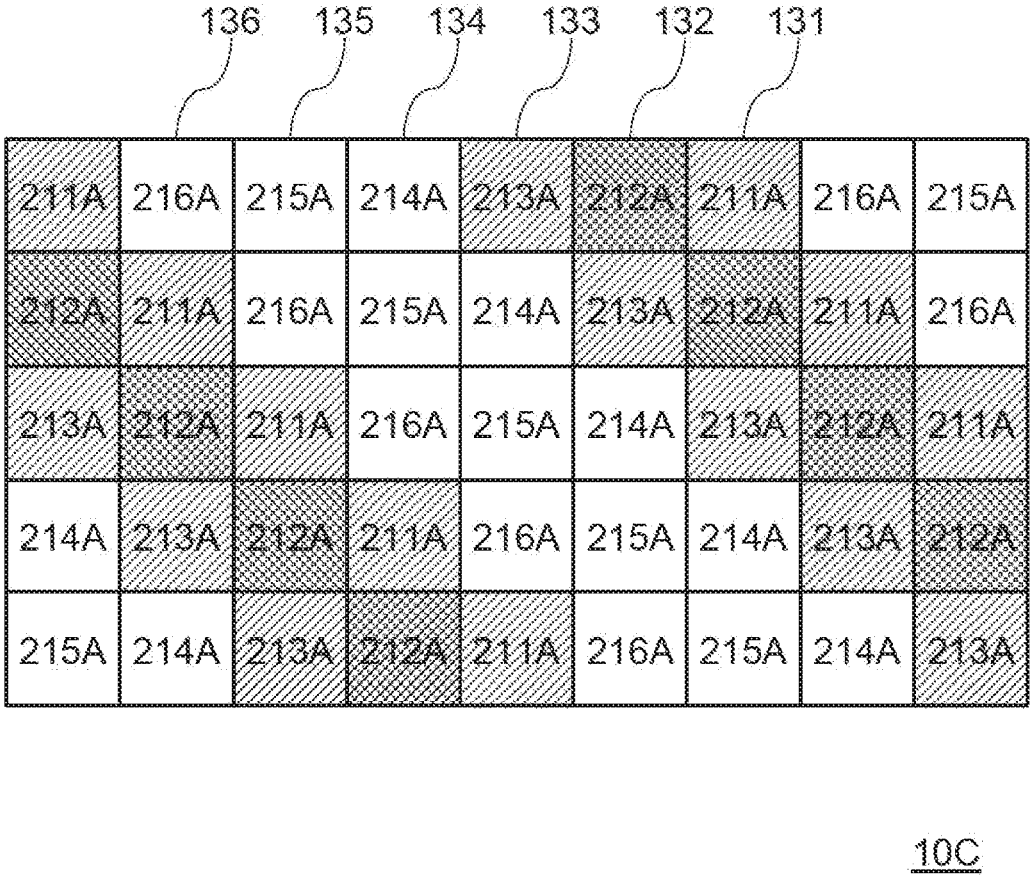
FIG. 14 is a schematic view of a backlight 10C in a case that a driver 212A has an abnormality.

FIG. 14 is a schematic view of a backlight 10C in a case that the driver 212A has an abnormality. In the backlight 10C illustrated in FIG. 14, the LEDs 11 are driven in drive units 131 to 136, in each of which a total of 4 LEDs 11, horizontal 2×vertical 2, are connected in series. The drive units 131 to 136 the number of which is 54 in total, horizontal 9×vertical 6, are arranged in a matrix.

The drive units 131 to 136 are driven by a total of six drivers 211A to 216A. In FIG. 14, drive units 131 driven by the driver 211A are denoted by "211A" inside blocks thereof. Drive units 132 driven by the driver 212A are denoted by "212A" inside blocks thereof. Drive units 133 driven by the driver 213A are denoted by "213A" inside blocks thereof. Drive units 134 driven by the driver 214A are denoted by "214A" inside blocks thereof. Drive units 135 driven by the driver 215A are denoted by "215A" inside blocks thereof. Drive units 136 driven by the driver 216A are denoted by "216A" inside blocks thereof.

As illustrated in FIG. 14, any two longitudinally adjacent drive units are driven by different drivers and any two laterally adjacent drive units are driven by different drivers. The drive units arranged in a right-downward (left-upward) diagonal direction are driven by the same driver.

As illustrated in FIG. 14, the drive units 132 are incapable of being driven because the driver 212A has an abnormality. Thus, in FIG. 14, the drive units 132 are cross-hatched. Note that, when a configuration similar to that of the first embodiment described above is employed, even if the driver 212A has an abnormality with the drivers 211A to 216A being cascaded, the drivers 211A and 213A to 216A can drive the drive units 131, and 133 to 136, for example. The control unit 22A can detect the driver 212A having an abnormality, based on whether notifications are received from the drivers 211A to 216A.

The drive units 131 and 133 adjacent to the drive units 132 in the longitudinal and lateral directions increase in light emission amounts to be larger than a normal case. Note that the "normal case" refers to a case that the drivers 211A to 216A are capable of driving all of the drive units 131 to 136. In FIG. 14, the drive units 131 and 133 increasing in the light emission amounts are hatched.

At this time, the control unit 22A adjusts the drive data directed to the drivers 211A and 213A to adjust the light emission amounts of the drive units 131 and 133. For example, in a case that the LED 11 is dimming-controlled with the PWM and the drive data is data defining the duty ratio, the control unit 22A increases the duty ratio of the drive data directed to the drivers 211A and 213A. As a result, the drivers 211A and 213A increase the light emission amounts of the drive units 131 and 133.

In FIG. 14, although the case is illustrated in which the driver 212A has an abnormality, in a case also that another driver has an abnormality, the drive unit is driven in the same manner. FIG. 15 is a table illustrating a driving method of a drive unit by a driver having no abnormality in a case that each of the drivers 211A to 216A has an abnormality. In FIG. 15, cross-marks indicate the drivers having abnormalities. Numerals "1" and "1.5" indicate the light emission amounts of the drive unit, and "1" indicates the same light emission amount as the normal case, and "1.5" indicates the light emission amount of 1.5 times from the normal case. Note that this "1.5" is merely exemplary, and the degree to which the light emission amount of the drive unit is increased is not limited to 1.5 times from the normal case.

As illustrated in FIG. 15, in the case that the driver 211A has an abnormality, the drivers 212A and 216A increases the light emission amount of the drive units 132 and 136 by 1.5 times from the normal case, and the drivers 213A to 215A set the light emission amounts of the drive units 133 to 135 to be the same as the normal case. In the case that the driver 212A has an abnormality, the drivers 211A and 213A increase the light emission amounts of the drive units 131 and 133 by 1.5 times from the normal case, and the drivers 214A to 216A set the light emission amounts of the drive units 134 to 136 to be the same as the normal case. In the case that the driver 213A has an abnormality, the drivers 212A and 214A increase the light emission amounts of the drive units 132 and 134 by 1.5 times from the normal case, and the drivers 211A, 215A, and 216A set the light emission amounts of the drive units 131, 135, and 136 to be the same as the normal case. In the case that the driver 214A has an abnormality, the drivers 213A and 215A increase the light emission amounts of the drive units 133 and 135 by 1.5 times from the normal case, and the drivers 211A, 212A, and 216A set the light emission amounts of the drive units 131, 132 and 136 to be the same as the normal case. In the case that the driver 215A has an abnormality, the drivers 214A and 216A increase the light emission amounts of the drive units 134 and 136 by 1.5 times from the normal case, and the drivers 211A to 213A set the light emission amounts of the drive units 131 to 133 to be the same as the normal case. In the case that the driver 216A has an abnormality, the drivers 211A and 215A increase the light emission amounts of the drive units 131 and 135 by 1.5 times from the normal case, and the drivers 212A to 214A set the light emission amounts of the drive units 132 to 134 to be the same as the normal case.

Incidentally, as illustrated in FIG. 14, in a case where the drivers 211A and 213A increase the light emission amounts of the drive units 131 and 133 to be larger than the normal case, a portion of an image displayed on the display device may be unnaturally lightened. Thus, the display device includes an image data adjusting unit configured to adjust the image data provided to the display panel to suppress the unnatural lightening of a portion of the image displayed on the display device.

Figure 16:
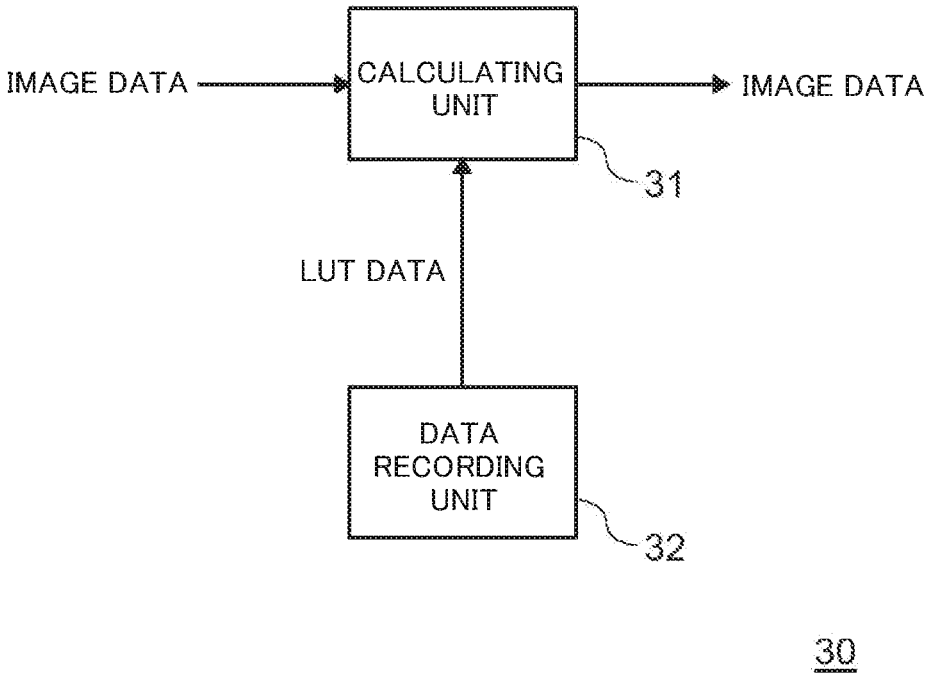
FIG. 16 is a block diagram illustrating an internal configuration of a control unit.

FIG. 16 is a block diagram illustrating a configuration of the image data adjusting unit 30. As illustrated in FIG. 16, the image data adjusting unit 30 includes a calculating unit 31 and a data recording unit 32. The calculating unit 31 adjusts a pixel value of a particular pixel in the image data, with reference to Look Up Table (LUT) data recorded by the data recording unit 32. The calculating unit 31 includes a calculating device such as a microprocessor, for example. The data recording unit 32 includes a recording device such as a semiconductor memory, for example. Note that the image data adjusting unit 30 is configured as part of the control unit 22A.

Figure 17:
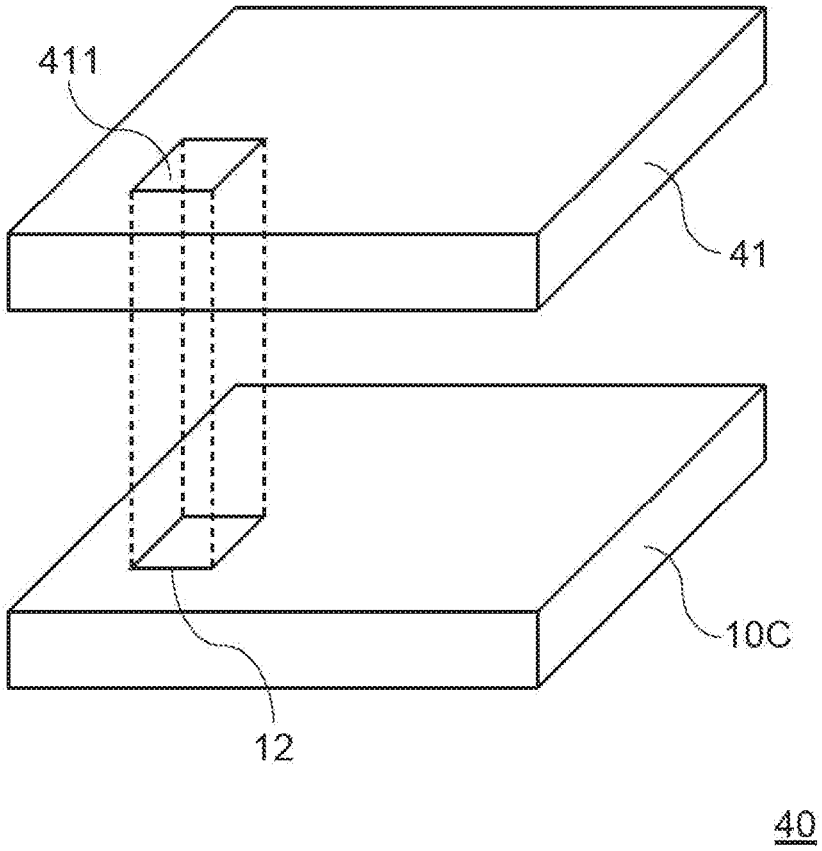
FIG. 17 is an exploded perspective view illustrating a configuration of a display device 40.

Here, a relationship between a drive unit of which the light emission amount is increased to be larger than the normal case and a position of a pixel of which the pixel value the image data adjusting unit 30 adjusts will be described with reference to FIG. 17. FIG. 17 is an exploded perspective view of a display device 40. As illustrated in FIG. 17, the display device 40 includes the backlight 10C and a display panel 41. The display panel 41 is a liquid crystal display panel including, for example, a liquid crystal layer, and is layered on the backlight 10C.

The display panel 41 controls a transmission amount of light emitted by the backlight to display an image. At this time, a pixel 411 in the display panel 41 located directly above the drive unit 12 controls the transmission amount of light emitted by the drive unit 12 to display a portion of the image. Hereinafter, the pixel 411 in the display panel 41 located directly above the drive unit is referred to as a "pixel corresponding to drive unit".

In the backlight 10C illustrated in FIG. 14, the image data adjusting unit 30 adjusts the image data so that the pixel values of the pixels in the liquid crystal panel located directly above the drive units 131 and 133 driven by the drivers 211A and 213A are values for being darker than the normal case. Specifically, in the image data adjusting unit 30, the calculating unit 31 adjusts the pixel values of the image data in accordance with a correspondence relationship indicated by the LUT data recorded by the data recording unit 32.

Figure 18:
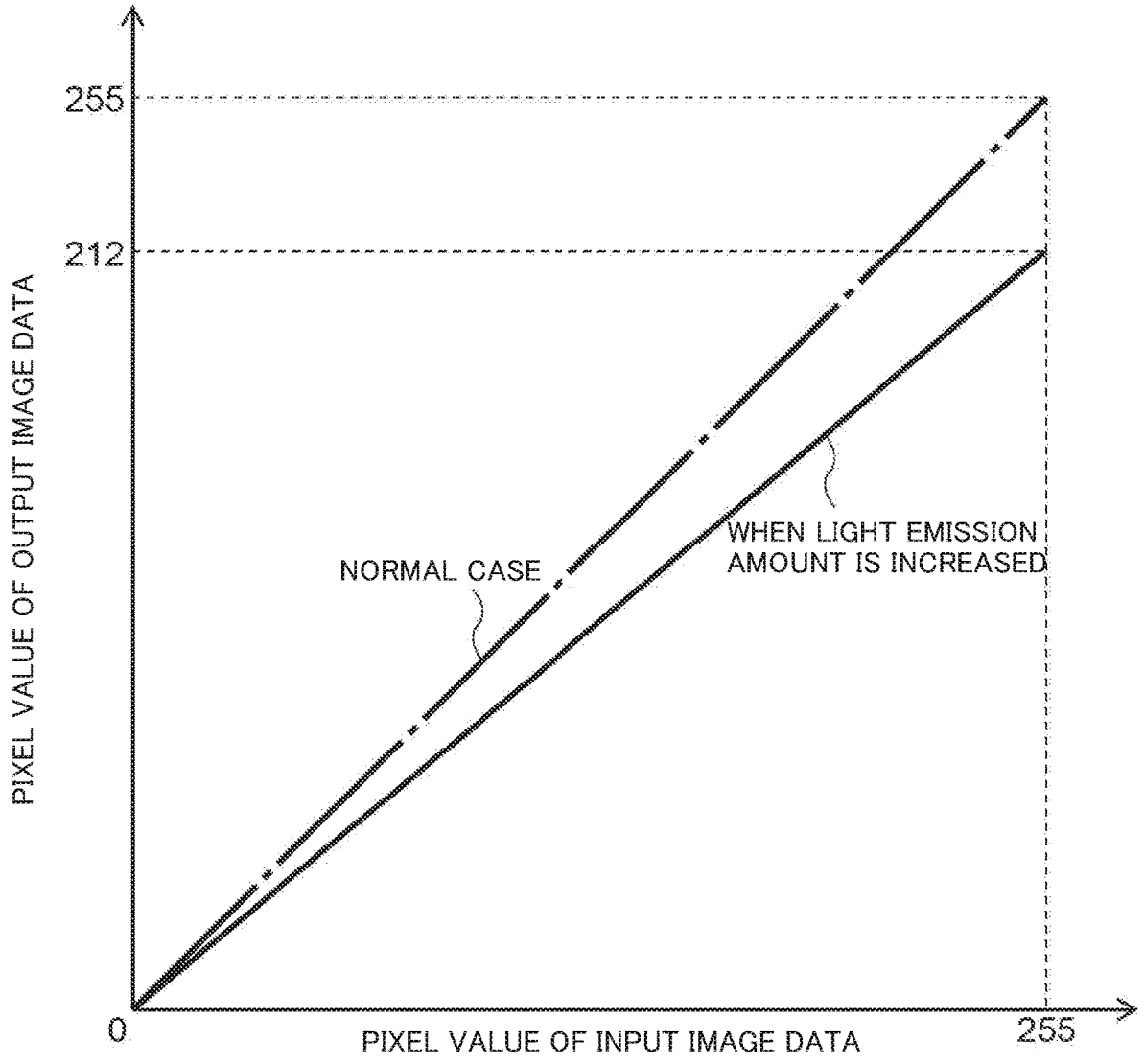
FIG. 18 is a graph illustrating LUT data.

The LUT data is data specifying a correspondence relationship between the pixel values of the image data input to the image data adjusting unit 30 and the pixel values of the image data output from the image data adjusting unit 30. FIG. 18 is a graph illustrating the LUT data. In FIG. 18, a horizontal axis represents a pixel value of the image data input to the image data adjusting unit 30, and a vertical axis represents a pixel value of the image data output from the image data adjusting unit 30. In FIG. 18, pixel values of pixels corresponding to the drive units of which the light emission amounts are the same as the normal case are indicated by dash-dot-dash line, and pixel values of pixels corresponding to the drive units of which the light emission amounts are increased to be larger than the normal case are indicated by solid line.

As illustrated in FIG. 18, in the pixel corresponding to the drive unit of which the light emission amount is the same as the normal case, the pixel value of the image data input to the image data adjusting unit 30 is the same as the pixel value of the image data output from the image data adjusting unit 30. On the other hand, in the pixel corresponding to the drive unit of which the light emission amount is increased to be larger than the normal case, the pixel value of the image data output from the image data adjusting unit 30 is smaller (i.e., a darker value) than the pixel value of the image data input to the image data adjusting unit 30.

Here, the correspondence relationship indicated by the solid line illustrated in FIG. 18 assumes a case that gamma correction is performed at a gamma value 2.2 in the display device 40, and the light emission amounts of the drive units adjacent to the drive unit incapable of being driven in the longitudinal and lateral directions are increased by 1.5 times from the normal case. In this case, if the pixel value is converted in accordance with the corresponding relationship indicated by the solid line, the luminance on the display when the light emission amount of the drive unit is the same as the normal case (luminance visible to a person) can be made to be the same as the luminance on the display when the light emission amount of the drive unit is increased by 1.5 times from the normal case.

As described above, in the fifth embodiment, the drivers 211A and 213A driving the drive units 131 and 133 adjacent to the drive unit 132 that is driven by the driver 212A having an abnormality in the longitudinal or lateral direction drive the drive units 131 and 133 to increase the light emission amounts to be larger than the normal case. As a result, the light emission amount of the entire backlight 10C can be maintained, and it is possible to suppress extreme darkening of the drive unit 132 incapable of being driven and a portion around the drive unit 132.

In the fifth embodiment, in the case that the driver 212A has an abnormality, the image data is adjusted so that the pixel values of the pixels corresponding to the drive units 131 and 133 driven by the drivers 211A and 213A are values for being darker than the normal case. Therefore, even if the drivers 211A and 213A that are some of the drivers increase the light emission amounts of the drive units 131 and 133, unnatural lightening of a portion of an image displayed on the display device can be suppressed.

Note that the drivers 211A to 216A may not be cascaded. In this case, the drive data may be configured to be input from the control unit or the like to each of the drivers 211A to 216A.

The drive units driven by the same driver may be drive units arranged in the right-upward (left-downward) diagonal direction, or may be drive units arranged in another manner. However, as illustrated in FIGS. 14 and 15, in a case where the drive units arranged in the diagonal direction are driven by the same driver, the drive units adjacent to drive unit driven by one driver in the longitudinal and lateral directions are to be driven by the other two drivers. As a result, in a case that one driver has an abnormality, only two drivers increase the light emission amounts to be larger than the normal case. Thus, the number of drivers that increase the light emission amounts to be larger than the normal case can be minimized.

The data recording unit 32 may record the table illustrated in FIG. 15 as the LUT data. Furthermore, in this case, the image data adjusting unit 221 may adjust the drive data, based on the LUT data to adjust the light emission amount of the drive unit.

In a case of a configuration in which magnitudes of currents flowing through the drive units 131 to 136 can be increased and decreased, the drivers 211A and 213A may increase the magnitudes of the currents flowing through the drive units 131 and 133 to increase the light emission amounts of the drive units 131 and 133.

In the description described above, the case is illustrated in which the image data adjusting unit 30 is configured as a part of the control unit 22A, but the image data adjusting unit 30 may be configured as a portion of another unit than the control unit 22A (for example, a host of the display device 40). The display device 40 may not include the image data adjusting unit 30.

Sixth Embodiment

Next, a sixth embodiment will be described. Note that, in the following description, in a case that the same reference numerals as in the first to fifth embodiments are used, the same configurations as in the first to fifth embodiments are illustrated, and reference is made to the preceding description unless otherwise described. Hereinafter, differences, in the sixth embodiment, from the first to fifth embodiments will be described, and description of a similar configuration will be omitted.

The sixth embodiment relates to a driving method of other drive units in a case that some drive units are incapable of being driven. Note that the sixth embodiment assumes a case that some drive units driven by a specific driver are incapable of being driven.

FIGS. 19 to 21 are each a table illustrating the driving method of other drive units in the case that some drive units are incapable of being driven. Note that FIGS. 19 to 21 illustrates the driving methods in the case of driving the backlight 10C similar to that of FIG. 14. However, in FIGS. 19 to 21, the light emission amounts are described inside blocks corresponding to the drive units. In FIGS. 19 to 21, the block cross-hatched and denoted by "0" therein represents a block incapable of being driven. Numerals "1", "1.25", "1.375", and "1.5" indicate the light emission amounts of the drive unit, and "1" indicates the same light emission amount as the normal case, "1.25" indicates the light emission amount of 1.25 times from the normal case, "1.375" indicates the light emission amount of 1.375 times from the normal case, and "1.5" indicates the light emission amount of 1.5 times from the normal case. Note that this "1.25", "1.375", and "1.5" are merely exemplary, and the degree to which the light emission amount of the drive unit is increased is not limited to 1.25, 1.375, and 1.5 times from the normal case.

As illustrated in FIGS. 19 to 21, in a case that a particular drive unit is incapable of being driven, the drivers that drive the drive units adjacent to the drive unit incapable of being driven in the longitudinal and lateral directions increase the light emission amounts of these drive units to be larger than the normal case. For example, when a configuration similar to that of the fifth embodiment described above is employed, the light emission amount of the drive unit can be increased to be larger than the normal case. At this time, the control unit stores the table as illustrated in FIGS. 19 to 21 (e.g., a table in the case that the drive units of the backlight 10C are incapable of being driven) as the LUT data, and may adjust the drive data, based on the LUT data. For example, when a configuration similar to that of the third embodiment described above is employed, the control unit can acquire the determination result data generated by the calculating unit 2113 of the driver 211B to detect the drive unit incapable of being driven.

FIG. 19 illustrates a case that the drive unit located inward away from an end side of the backlight is incapable of being driven. As illustrated in FIG. 19, a total of four drive units are adjacent on both sides of the drive unit that is incapable of being driven in the longitudinal and lateral directions. In this case, the driver driving the total of four drive units increases the light emission amount of the drive unit by 1.25 times from the normal case.

FIG. 20 illustrates a case that the drive unit located at the corner of the backlight is incapable of being driven. As illustrated in FIG. 20, a total of two drive units are adjacent on one side of the drive unit that is incapable of being driven in the longitudinal and lateral directions. In this case, the driver driving the total of two drive units increases the light emission amount of the drive unit by 1.5 times from the normal case.

FIG. 21 illustrates a case that the drive unit located on an end side of the backlight is incapable of being driven. As illustrated in FIG. 21, the drive units are adjacent on both sides of the drive unit that is incapable of being driven in the longitudinal direction and on one side of the drive unit in the lateral direction. In this case, the driver that drives the total of three drive units increases the light emission amount of the drive unit by 1.375 times from the normal case.

As described above, in the sixth embodiment, in a case that a certain drive unit is incapable of being driven, the driver increases the light emission amounts of the drive units adjacent to the drive unit incapable of being driven in the longitudinal and lateral directions to be larger than the normal case. As a result, the light emission amount of the entire backlight can be maintained, and it is possible to suppress extreme darkening of the drive unit incapable of being driven and a portion around the drive unit.

In the sixth embodiment, in the case that a certain drive unit is incapable of being driven, the fewer the number of drive units adjacent to the drive unit incapable of being driven in the longitudinal and lateral directions, the larger the driver increases the light emission amounts of the adjacent drive units to be. As a result, even if a drive unit located in any position in the backlight is incapable of being driven, the light emission amount of the entire backlight can be maintained, and it is possible to suppress extreme darkening of the drive unit incapable of being driven and a portion around the drive unit.

Note that, in the sixth embodiment as well, similar to the fifth embodiment, the image data may be adjusted so that the pixel value of the pixel corresponding to the drive unit of which the light emission amount is a value for being darker than the normal case. In this case, even if the light emission amounts of some drive units are increased, unnatural lightening of a portion of an image displayed on the display device can be suppressed. The control unit having the configuration illustrated in FIG. 16 may adjust the image data using the LUT table illustrated in FIG. 18.

MODIFICATION EXAMPLE

The above-described embodiments are merely examples for carrying out the present disclosure. Thus, the present disclosure is not limited to the embodiments described above, and can be carried out by appropriately modifying the embodiments described above without departing from the scope.

For example, in the first and second embodiments described above, the cases are illustrated in which the control units 22 and 22A output the drive data D211, the drive data D212, and the drive data D213 in this order in the period T1, and output the drive data D213, the drive data D212, and the drive data D211 in this order in the period T2 (see FIGS. 4 and 7). However, the control units 22 and 22A may output the drive data D211 to D213 in any order.

For example, in the first and second embodiments described above, the case is illustrated in which each of the drivers 211 to 213 and 211A to 213A receives the drive data directed to each driver itself input from the previous stage, each driver does not output the drive data to the subsequent stage. However, each of the drivers 211 to 213 and 211A to 213A, in a case of receiving drive data directed to each driver itself input from the previous stage, may output the drive data to the subsequent stage.

For example, in the first to sixth embodiments described above, the case is illustrated in which four LEDs 11 connected in series constitute one drive unit 12. However, the number of LEDs 11 constituting one drive unit 12 may be arbitrary. For example, one drive unit 12 may be constituted by one LED 11, may be constituted by two or three LEDs 11, or may be constituted by five or more LEDs 11.

The first to sixth embodiments described above can be implemented in combination as far as consistency is concerned.

The backlight driving device described above can be described as follows.

A backlight driving device includes a plurality of drivers configured to drive a plurality of light-emitting elements arranged in a planar shape in a predetermined drive unit, and a control unit configured to output drive data directed to each of the plurality of drivers, wherein the plurality of drivers are cascaded, each of the plurality of drivers bi-directionally performs an operation of, in a case of receiving the drive data directed to another driver input from a previous stage, outputting the drive data to a subsequent stage in a row of the plurality of drivers cascaded, and in a case that at least one of the plurality of drivers has an abnormality, the control unit outputs the drive data directed to each of the plurality of drivers to a driver located at one end of the plurality of drivers, and then outputs the drive data to a driver located at the other end of the plurality of drivers (first configuration).

According to this configuration, even in a case that some of the plurality of cascaded drivers cannot transfer the drive data, the drive data is provided to as many drivers as possible. Accordingly, as many light-emitting elements as possible can be driven to suppress degradation of display quality in the display device.

In the first configuration, each of the plurality of drivers may include a first input/output terminal and a second input/output terminal, and each of the plurality of drivers, in a case that the drive data directed to another driver is input to the first input/output terminal, may output, from the second input/output terminal, the drive data, and in a case that the drive data directed to another driver is input to the second input/output terminal, may output, from the first input/output terminal, the drive data (second configuration). According to this configuration, the respective drivers can transfer the drive data bi-directionally in a simple configuration with two input/output terminals.

In the first or second configuration, in a case that none of the plurality of drivers has abnormalities, the control unit may output the drive data directed to each of the plurality of drivers to only the driver located at the one end of the plurality of drivers (third configuration). According to this configuration, in the case that the respective drivers do not need to transfer the drive data bi-directionally, the drivers transfer the data only in one direction, so the operation in this case can be simplified.

In any of the first to third configurations, each driver of the plurality of drivers, in a case of receiving the drive data directed to the driver itself input from a previous stage, may not output the drive data to a subsequent stage (fourth configuration). According to this configuration, unnecessary data is not output to the subsequent state of each of the drivers, and thus, each driver can suppress power consumption and malfunction.

In any of the first to fourth configurations, each driver of the plurality of drivers, in a case of receiving the drive data directed to the driver itself, may provide a notification to the control unit (fifth configuration). According to this configuration, the control unit can determine that at least one of the plurality of drivers has abnormalities, based on whether a notification is received from each driver.

In any of the first to fifth configurations, the control unit may output error data representing whether the notification is received from each of the plurality of drivers (sixth configuration). According to this configuration, the host of the display device or the like, for example, can identify a faulty portion, based on this error data.

In any of the first to sixth configurations, each driver of the plurality of drivers may measure a voltage of an end on a cathode side of the drive unit driven by the driver itself (seventh configuration). According to this configuration, each driver can detect whether the drive unit driven by the driver itself has an abnormality, based on the voltage of the end.

The backlight driving device and the display device described above can be described as follows.

The backlight driving device includes a plurality of drivers that drive a plurality of light-emitting elements arranged in a planar shape in each of predetermined drive units arranged in a matrix, wherein any two longitudinally adjacent drive units are driven by two different drivers of the plurality of drivers, and any two laterally adjacent drive units are driven by two different drivers of the plurality of drivers (eighth configuration).

According to this configuration, even if a specific driver has abnormalities, the drive units caused thereby to be incapable of being driven are not adjacent to each other in the longitudinal and lateral directions, and are not congregated. Accordingly, it is possible to suppress degradation of the display quality in the display device.

In the eighth configuration, in a case that a first driver of the plurality of drivers has an abnormality, a second driver driving the drive unit adjacent to the drive unit driven by the first driver in the longitudinal or lateral direction may drive the drive unit to increase a light emission amount to be larger than a normal case (ninth configuration). According to this configuration, the light emission amount of the entire backlight can be maintained, and it is possible to suppress extreme darkening of the drive unit incapable of being driven and a portion around the drive unit.

In the ninth configuration, the drive units arranged in a right-upward diagonal direction may be driven by the same driver, or the drive units arranged in a right-downward diagonal direction may be driven by the same driver (tenth configuration). According to this configuration, the drive units adjacent to drive unit driven by one driver in the longitudinal and lateral directions are to be driven by the other two drivers. As a result, in a case that one driver has an abnormality, only two drivers increase the light emission amounts to be larger than the normal case. Thus, the number of drivers that increase the light emission amounts to be larger than the normal case can be minimized.

In any of the eighth to tenth configurations, in a case that a first drive unit of the drive units is incapable of being driven, the plurality of drivers may increase the light emission amounts of second drive units adjacent to the first drive unit in the longitudinal and lateral directions from the normal case (eleventh configuration). According to this configuration, the light emission amount of the entire backlight can be maintained, and it is possible to suppress extreme darkening of the drive unit incapable of being driven and a portion around the drive unit.

In the eleventh configuration, in the case that the first drive unit is incapable of being driven, the fewer the number of the second drive units, the larger the plurality of drivers may increase the light emission amounts of the second drive units to be (twelfth configuration). According to this configuration, even if a drive unit located in any position in the backlight is incapable of being driven, the light emission amount of the entire backlight can be maintained.

The display device includes a backlight driving device having the ninth or tenth configuration, a backlight having the plurality of light-emitting elements, a display panel layered on the backlight and controlling a transmission amount of light emitted by the backlight to display an image, and an image data adjusting unit adjusting image data provided to the display panel, wherein the image data adjusting unit adjusts the image data so that, in a case that the first driver has an abnormality, a pixel value of a pixel in a display panel located directly above the drive unit driven by the second driver is a value for being darker than the normal case (thirteenth configuration). According to this configuration, even if the second driver increases the light emission amount of the drive unit to be larger than the normal case, unnatural lightening of a portion of an image displayed on the display device can be suppressed.

The display device includes a backlight driving device having the eleventh or twelfth configuration, a backlight having the plurality of light-emitting elements, a display panel layered on the backlight and controlling a transmission amount of light emitted by the backlight to display an image, and an image data adjusting unit adjusting image data provided to the display panel, wherein the image data adjusting unit adjusts the image data so that, in a case that the first drive unit is incapable of being driven, a pixel value of a pixel in a display panel located directly above the second drive unit is a value for being darker than the normal case (fourteenth configuration). According to this configuration, even if the driver increases the light emission amount of the second drive unit to be larger than the normal case, unnatural lightening of a portion of an image displayed on the display device can be suppressed.

What is claimed is:

1. A backlight driving device comprising:

a plurality of drivers configured to drive a plurality of light-emitting elements arranged in a planar shape in a predetermined drive unit; and a control unit configured to output drive data directed to each of the plurality of drivers, wherein the plurality of drivers are cascaded, each of the plurality of drivers bi-directionally performs an operation of, in a case of receiving the drive data directed to another driver input from a previous stage, outputting the drive data to a subsequent stage in a row of the plurality of drivers cascaded, and in a case that at least one of the plurality of drivers has an abnormality, the control unit outputs the drive data directed to each of the plurality of drivers to a driver located at one end of the plurality of drivers, and then outputs the drive data to a driver located at the other end of the plurality of drivers.

2. The backlight driving device according to claim 1, wherein each driver of the plurality of drivers, in a case of receiving the drive data directed to the driver itself, provides a notification to the control unit.

3. The backlight driving device according to claim 2, wherein the control unit outputs error data representing whether the notification is received from each of the plurality of drivers.

4. The backlight driving device according to claim 1, wherein each of the plurality of drivers includes a first input/output terminal and a second input/output terminal, and each of the plurality of drivers, in a case that the drive data directed to another driver is input to the first input/output terminal, outputs, from the second input/output terminal, the drive data, and in a case that the drive data directed to another driver is input to the second input/output terminal, outputs, from the first input/output terminal, the drive data.

5. The backlight driving device according to claim 1, wherein in a case that none of the plurality of drivers has abnormalities, the control unit outputs the drive data directed to each of the plurality of drivers to only the driver located at the one end of the plurality of drivers.

6. The backlight driving device according to claim 1, wherein each driver of the plurality of drivers, in a case of receiving the drive data directed to the driver itself input from a previous stage, does not output the drive data to a subsequent stage.

7. The backlight driving device according to claim 1, wherein each driver of the plurality of drivers measures a voltage of an end on a cathode side of the drive unit driven by the driver itself.

* * * * *